US008328545B2

(12) United States Patent
Kobayashi et al.

(10) Patent No.: US 8,328,545 B2
(45) Date of Patent: Dec. 11, 2012

(54) SCROLL FLUID MACHINE WITH STABILIZED ORBITING SCROLL

(75) Inventors: Yoshio Kobayashi, Ebina (JP); Yoshiyuki Kanemoto, Samukawa (JP); Yuji Komai, Tokyo (JP); Kazutaka Suefuji, Kawasaki (JP); Kiminori Iwano, Yokohama (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 645 days.

(21) Appl. No.: 12/504,281

(22) Filed: Jul. 16, 2009

(65) Prior Publication Data

US 2010/0028185 A1 Feb. 4, 2010

(30) Foreign Application Priority Data

Jul. 31, 2008 (JP) ..... 2008-197995

(51) Int. Cl.
*F03C 2/00* (2006.01)
*F03C 4/00* (2006.01)
*F04C 18/00* (2006.01)

(52) U.S. Cl. ..... 418/55.3; 418/55.5; 418/57; 464/103

(58) Field of Classification Search ..... 418/55.1–55.6, 418/57, 152; 464/103, 102
See application file for complete search history.

(56) References Cited

U.S. PATENT DOCUMENTS

| | | | | |
|---|---|---|---|---|
| 4,468,181 | A | 8/1984 | Sakamoto | |
| 2009/0087331 | A1* | 4/2009 | Komai et al. | 418/55.3 |
| 2009/0110580 | A1* | 4/2009 | Suefuji et al. | 418/55.3 |

FOREIGN PATENT DOCUMENTS

| | | | |
|---|---|---|---|
| JP | 57-148090 | A | 9/1982 |
| JP | 58-135302 | A | 8/1983 |
| JP | 59-79087 | A | 5/1984 |
| JP | 59-116592 | U | 8/1984 |
| JP | 63-266215 | A | 11/1988 |
| JP | 2-34781 | U | 3/1990 |
| JP | 2003-65259 | A | 3/2003 |
| JP | 2006-283673 | A | 10/2006 |
| JP | 2008-248868 | A | 10/2008 |
| JP | 2009-85102 | A | 4/2009 |

OTHER PUBLICATIONS

JP 2003-065259 Komai et al. Scroll Type Fluid Machine Mar. 5, 2003_English Translation.*

Japanese Office Action including English language translation dated May 8, 2012 (Six (6) pages).

* cited by examiner

*Primary Examiner* — Theresa Trieu
(74) *Attorney, Agent, or Firm* — Crowell & Moring LLP

(57) ABSTRACT

A scroll fluid machine comprises a fixed-side member including a cylindrical casing and a fixed scroll fixed to the casing, and an orbiting scroll and a plurality of ball coupling devices provided between the fixed-side member and the orbiting scroll to prevent self-rotation of the orbiting scroll on its axis and receive a thrust load between the fixed-side member and the orbiting scroll. Each of the ball coupling devices comprises a first ball coupling mechanism for supporting the thrust load generated between the fixed-side member and the orbiting scroll and a second ball coupling mechanism disposed with a space from the first ball coupling mechanism to prevent the self-rotation of the orbiting scroll.

13 Claims, 12 Drawing Sheets

SCROLL FLUID MACHINE WITH STABILIZED ORBITING SCROLL

INCORPORATION BY REFERENCE

The present application claims priority from Japanese application JP2008-197995 filed on Jul. 31, 2008, the content of which is hereby incorporated by reference into this application.

BACKGROUND OF THE INVENTION

The present invention relates to a scroll fluid machine which is preferably used as an air compressor or a vacuum pump, for example.

As a scroll fluid machine, there is generally known a scroll compressor configured to continuously compress a fluid such as air in compression chambers between an orbiting scroll and a fixed scroll by orbiting the orbiting scroll relative to the fixed scroll without allowing the orbiting scroll to self-rotate on its axis by a drive source such as an electric motor (see JP-A-2006-283673, for example).

In this type of scroll compressor according to the related art, three ball coupling devices are provided between a casing of the compressor and the orbiting scroll, thereby receiving a thrust load (a load in a direction in which the orbiting scroll is axially separated from the fixed scroll) between the casing and the orbiting scroll, and preventing the self-rotation of the orbiting scroll on its axis.

Each of the aforementioned ball coupling devices according to the related art includes a pair of support members provided facing each other in the casing and the orbiting scroll, and a spherical ball provided for rotation between the support members. In this case, the ball supports the thrust load on the orbiting scroll and also prevents the self-rotation of the orbiting scroll on its axis.

In the related art, the thrust load on the orbiting scroll is supported and the self-rotation thereof is prevented at the same time by using the pair of support members for supporting the spherical ball for rotation. Thus, ball support surfaces (rolling surfaces) of the support members on which the ball rolls need to be accurately processed in both of an orbiting direction and an axial direction, and it is difficult to improve product yield.

SUMMARY OF THE INVENTION

The present invention has been made in view of the aforementioned problem of the related art, and it is an object of the present invention to provide a scroll fluid machine capable of stabilizing behavior of an orbiting scroll in an orbiting direction, and improving product yield.

In order to achieve the above object, the present invention is applied to a scroll fluid machine comprising: a fixed-side member having a cylindrical casing and a fixed scroll fixed to the casing and having a spiral wrap portion erected on an end plate; an orbiting scroll provided for orbit in the casing so as to face the fixed scroll of the fixed-side member and having a spiral wrap portion erected on an end plate; a plurality of fluid chambers defined between the orbiting scroll and the fixed scroll to compress or expand a fluid between the two wrap portions when the orbiting scroll orbits; and a plurality of ball coupling devices provided between the fixed-side member and the orbiting scroll to prevent self-rotation of the orbiting scroll on its axis and receive a thrust load between the fixed-side member and the orbiting scroll.

In a configuration according to a first aspect of the invention, each of the ball coupling devices comprises a first ball coupling mechanism for supporting the thrust load generated between the fixed-side member and the orbiting scroll by using a load supporting ball, and a second ball coupling mechanism disposed with a space from the first ball coupling mechanism to prevent the self-rotation of the orbiting scroll on its axis by using a self-rotation preventing ball, and the second ball coupling mechanism includes an elastic member for elastically supporting the self-rotation preventing ball in a radial direction.

In a configuration according to a second aspect of the invention, each of the ball coupling devices includes a first ball coupling mechanism including a pair of thrust support members provided facing each other in the fixed-side member and the orbiting scroll and having ball support surfaces facing each other to receive the thrust load, and a load supporting ball held between the pair of thrust support members to receive the thrust load via the respective ball support surfaces, and a second ball coupling mechanism including a pair of self-rotation suppressing support members provided facing each other in the fixed-side member and the orbiting scroll and having ball support surfaces facing each other to prevent the self-rotation of the orbiting scroll on its axis, and a self-rotation preventing ball held between the pair of self-rotation suppressing support members to prevent the self-rotation of the orbiting scroll on its axis via the respective ball support surfaces, and the second ball coupling mechanism comprises an elastic member for elastically supporting the self-rotation preventing ball in a radial direction of the orbiting scroll and in the second ball coupling mechanism, an orbit radius of the self-rotation preventing ball when the orbiting scroll orbits is made smaller than an orbiting radius of the orbiting scroll, and the elastic member is elastically deformed in a radial direction by a difference between the orbiting radius of the orbiting scroll and the orbit radius of the self-rotation preventing ball.

In a configuration according to a third aspect of the invention, each of the ball coupling devices includes a first ball coupling mechanism for supporting the thrust load generated between the fixed-side member and the orbiting scroll by using a load supporting ball, and a second ball coupling mechanism disposed with a space from the first ball coupling mechanism to prevent the self-rotation of the orbiting scroll on its axis by using a self-rotation preventing ball, and the self-rotation preventing ball of the second ball coupling mechanism is formed of a spherical elastic member that is elastically deformable with a larger deformation allowance than those of the fixed-side member, the orbiting scroll and the first ball coupling mechanism.

According to the present invention, since the aforementioned configurations are employed, a force in a direction in which the orbiting scroll self-rotates on its axis can be restrained by using the second ball coupling mechanism even in a large scroll fluid machine in which the orbiting scroll has a large inertia moment, for example, and a more stable self-rotation preventing effect can be obtained, and the orbiting scroll is allowed to orbit smoothly. Since the first and second ball coupling mechanisms are used, a function of supporting the thrust load and a function of preventing the self-rotation on its axis can be separated from each other. Therefore, design specifications based on the magnitude of the thrust load can be applied to the first ball coupling mechanism, and design specifications based on the magnitude of the rotational force can be applied to the second ball coupling mechanism.

As a result, the dimensional tolerances of the first and second ball coupling mechanisms can be relaxed in comparison with the related art in which the two functions of supporting the thrust load on the orbiting scroll and preventing the self-rotation thereof are combined. Herewith, the product yield can be improved, and the production cost and management cost can be reduced. Furthermore, the elastic member provided in the second ball coupling mechanism elastically supports the self-rotation preventing ball in the radial direction. Therefore, for example, even when the dimensional tolerances of the components are relaxed, the elastic member can suppress the backlash occurring in the self-rotation preventing ball in the rotational direction of the orbiting scroll. The load supporting ball can be prevented from sliding along the ball support surfaces on which the load supporting ball rolls, thereby preventing occurrence of abrasion, damage of the ball and the ball support surfaces.

Other objects, features and advantages of the invention will become apparent from the following description of the embodiments of the invention taken in conjunction with the accompanying drawings.

DETAILED DESCRIPTION OF PREFERRED EMBODIMENTS

Figure 1:
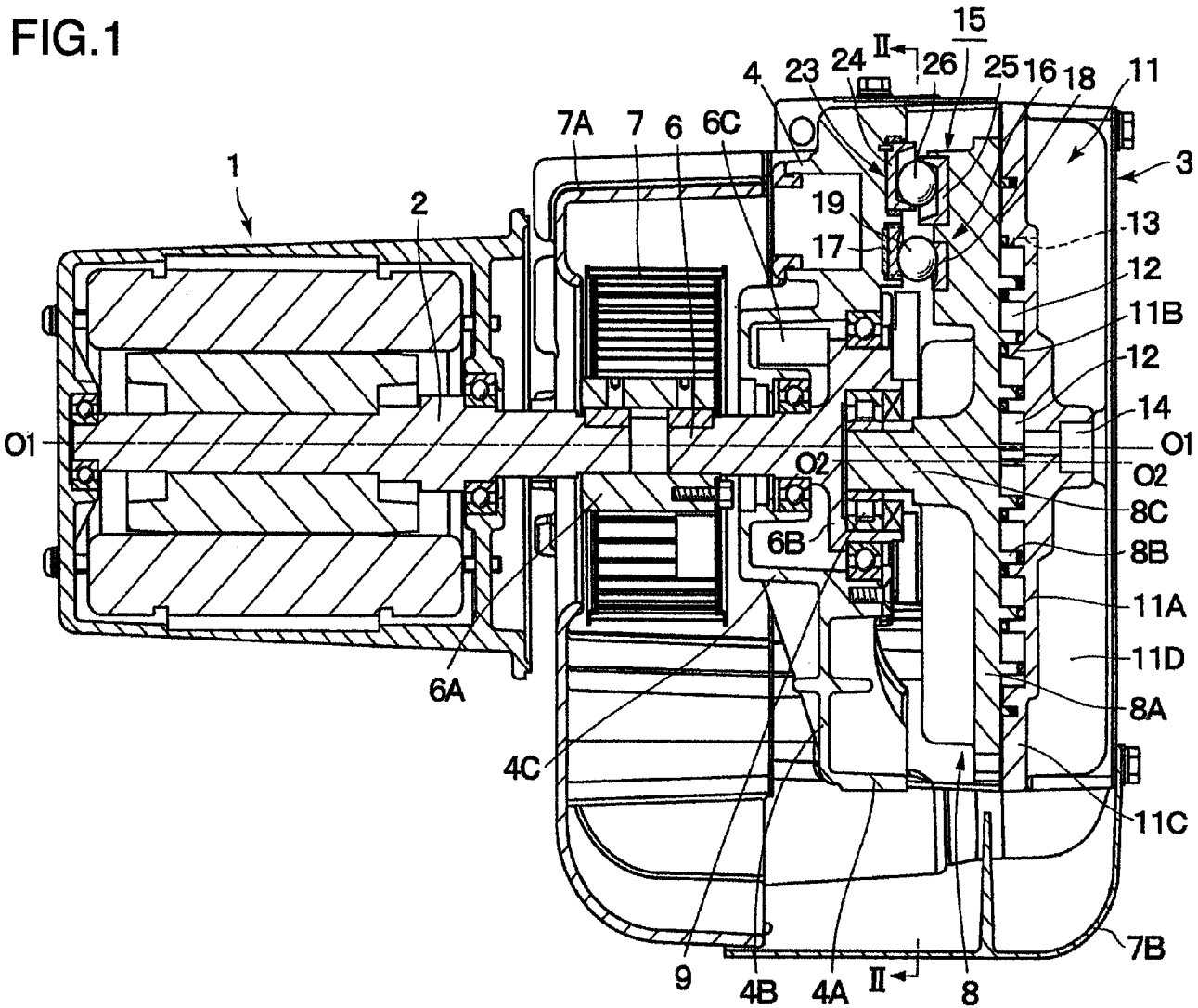
FIG. 1 is a longitudinal sectional view of a scroll air compressor according to a first embodiment of the present invention as viewed from the direction of an arrow I-I in FIG. 2.

Hereinafter, a scroll fluid machine according to the present invention will be described in detail with reference to the accompanying drawings by citing a case in which the scroll fluid machine is applied to an oilless air compressor.

FIGS. 1 to 6 illustrate a first embodiment according to the present invention. In the drawings, reference numeral 1 denotes an electric motor which constitutes a drive source of an air compressor. The electric motor 1 rotationally drives an output shaft 2 when it receives power supply from the outside, and thereby performs a compression operation of a compressor body 3 (described hereinafter).

Reference numeral 3 denotes the scroll compressor body which is driven by the electric motor 1. The compressor body 3 includes a casing 4 which constitutes an outer frame of the compressor body 3, a drive shaft 6, an orbiting scroll 8, a fixed scroll 11, and ball coupling devices 15, which will be described hereinafter. The casing 4 of the compressor body 3 and the fixed scroll 11 (described hereinafter) constitute a fixed-side member that is a constituent feature of the present invention.

In this case, the casing 4 is made of metal material such as aluminum, and is formed as a bottomed cylindrical body which opens on one side in an axial direction. The casing 4 comprises a cylinder portion 4A which extends in a square cylindrical shape in the axial direction (an axis line O1-O1), a bottom portion 4B which is provided on the other side of the cylinder portion 4A in the axial direction, and a bearing mount portion 4C which is integrally provided with the bottom portion 4B at a center thereof and is formed as a stepped cylindrical body having a smaller diameter than that of the cylinder portion 4A.

Figure 3:
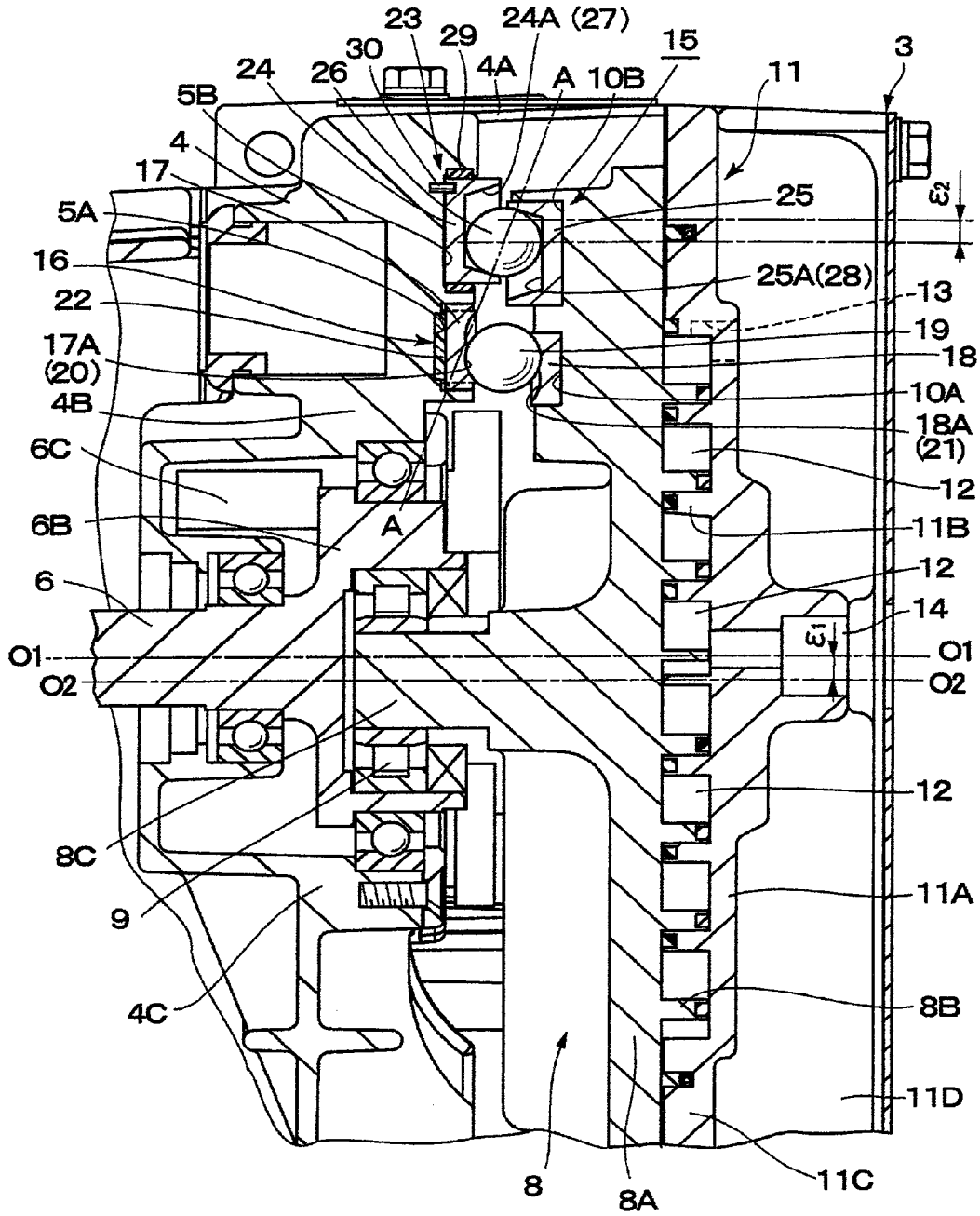
FIG. 3 is a partially-enlarged sectional view illustrating a casing, an orbiting scroll, a fixed scroll, a ball coupling device or the like in FIG. 1.

First and second support member mount portions 5A and 5B for the ball coupling device 15 (described hereinafter) are provided in the bottom portion 4B of the casing 4 at positions axially facing the orbiting scroll 8 (described hereinafter) on an outer side of the bearing mount portion 4C in the radial direction as shown in FIG. 3. Each of the first and second support member mount portions 5A and 5B is formed as a circular recess (a bottomed hole). The first and second support member mount portions 5A and 5B are respectively provided at three positions at intervals in a circumferential direction of the casing 4, for example.

The first and second support member mount portions 5A and 5B are disposed with a space from each other in the radial direction of the casing 4. As shown in FIGS. 3 to 6, a thrust support member 17 of a ball coupling mechanism 16 (described hereinafter) is fitted in the first support member mount portion 5A. A self-rotation suppressing support member 24 of a ball coupling mechanism 23 (described hereinafter) is fitted in the second support member mount portion 5B that is located on an outer side of the first support member mount portion 5A in the radial direction.

Figure 5:
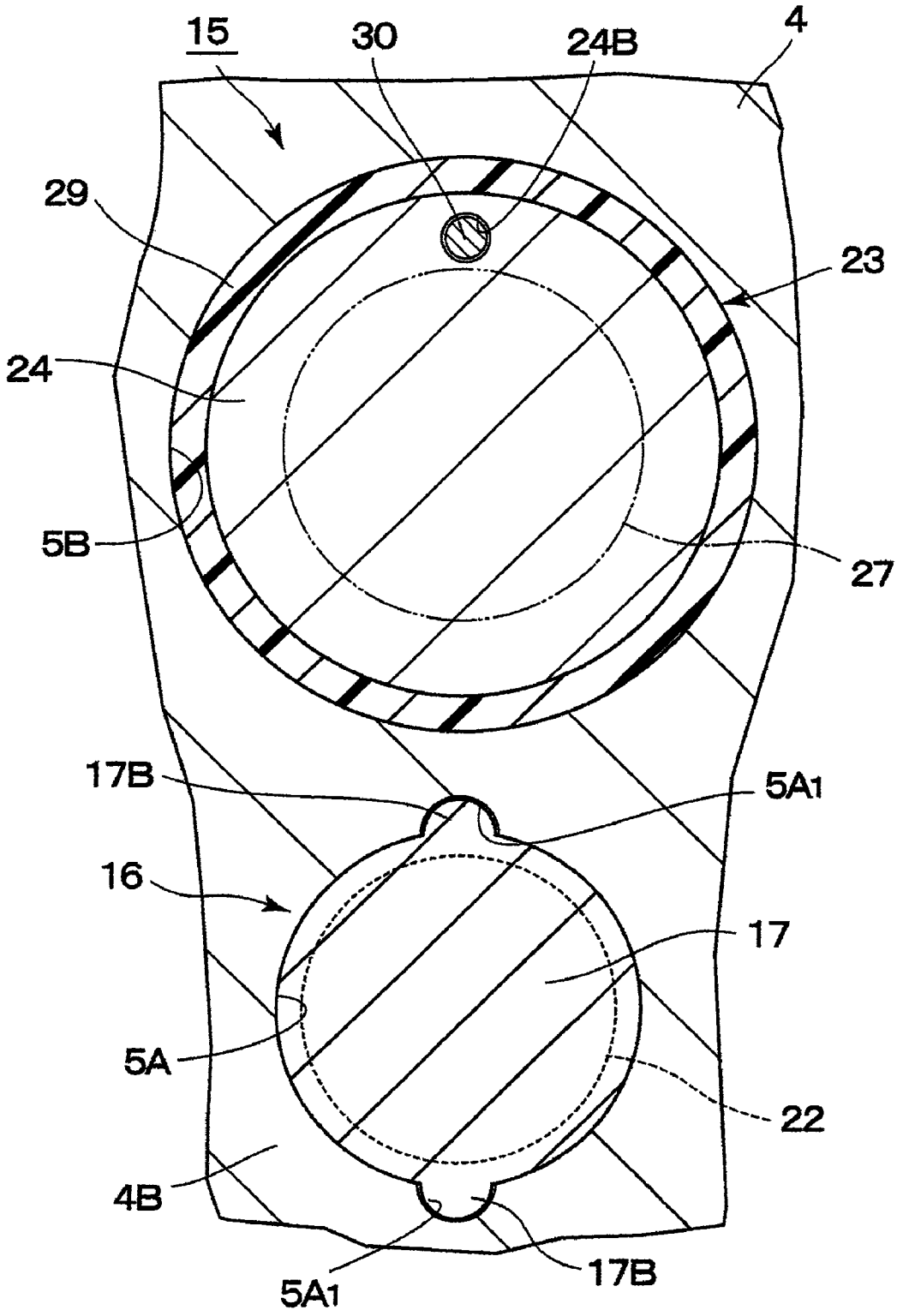
FIG. 5 is a sectional view of the ball coupling device as viewed from the direction of an arrow V-V in FIG. 4.
Figure 6:
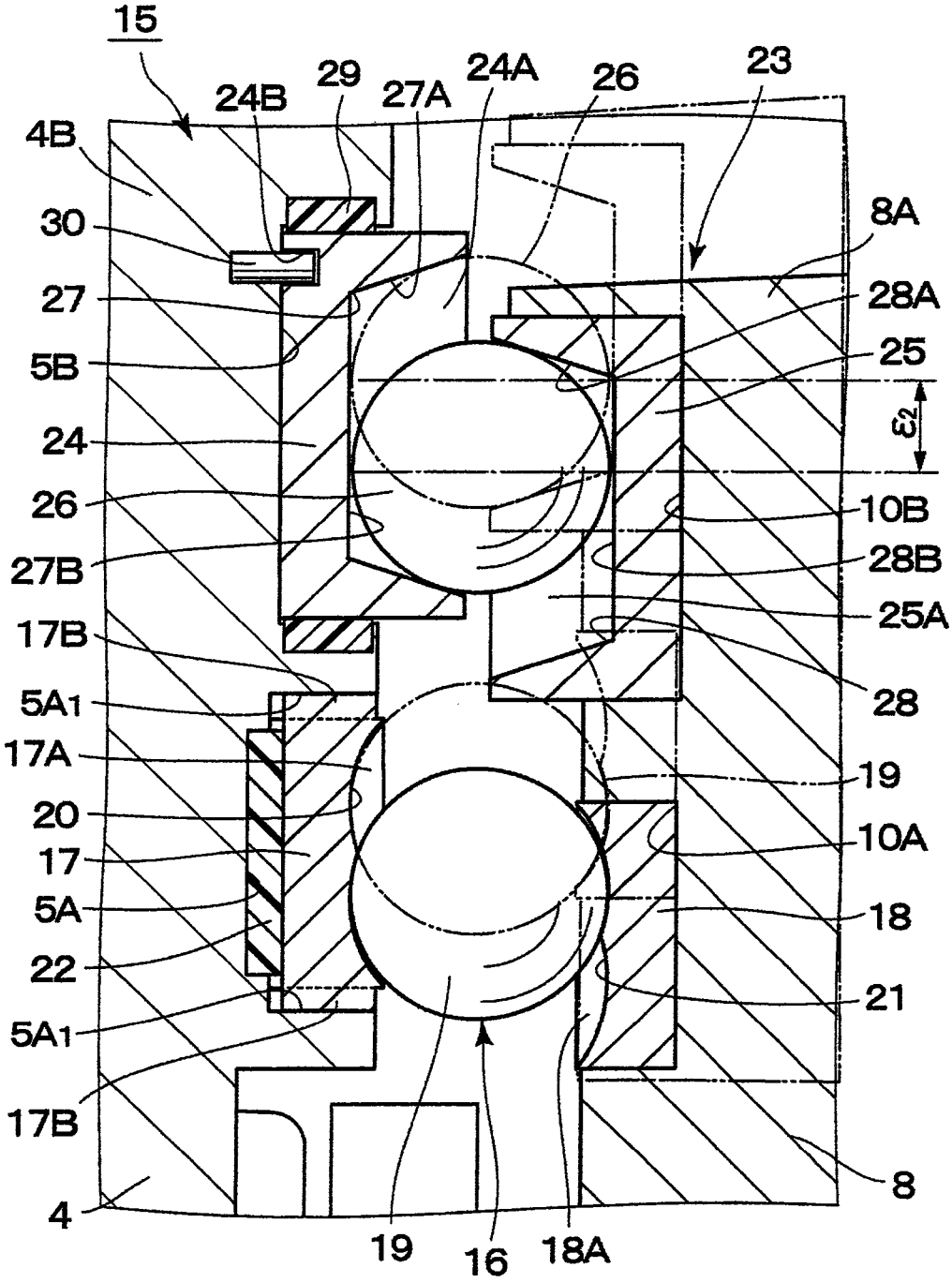
FIG. 6 is a detailed sectional view illustrating the movement of the ball coupling device at the same position as that in FIG. 4.

As shown in FIG. 5, pair of rotation preventing grooves 5A1 and 5A1, which are recessed grooves with small diameters, are formed in a peripheral wall of the first support member mount portion 5A. Rotation preventing projections 17B of the thrust support member 17 (described hereinafter) are respectively engaged with the rotation preventing grooves 5A1. Meanwhile, the second support member mount portion 5B is formed as a bottomed hole having a larger diameter than that of the first support member mount portion 5A. An elastic ring 29 is mounted with interference on a peripheral wall side of the second support member mount portion 5B with no space between the elastic ring 29 and the self-rotation suppressing support member 24 (described hereinafter).

Reference numeral 6 denotes the drive shaft which rotates about the axis line O1-O1. The drive shaft 6 is rotatably supported in the bearing mount portion 4C of the casing 4 via a bearing. The drive shaft 6 is detachably coupled to the output shaft 2 of the electric motor 1 by using a shaft coupling 6A as shown in FIG. 1, thereby rotating with the output shaft 2.

A cylindrical crank portion 6B is provided on one side of the drive shaft 6 in the axial direction. The cylindrical crank portion 6B is formed eccentrically relative to the axis line O1-O1 of the drive shaft 6 by a predetermined dimension $\epsilon 1$ (see FIG. 3). A coupling shaft portion 8C of the orbiting scroll 8 (described hereinafter) and an orbiting bearing 9 are mounted in the crank portion 6B. A balance weight 6C for stabilizing the orbiting movement of the orbiting scroll 8 is provided on an outer peripheral side of the drive shaft 6.

Reference numeral 7 denotes a cooling fan as cooling means for cooling inside and outside of the casing 4. The cooling fan 7 comprises a centrifugal fan located on an outer peripheral side of the drive shaft 6 and mounted to the other side of the drive shaft 6 in the axial direction. The cooling fan 7 is housed in a fan casing 7A. The inside of the fan casing 7A communicates with a duct 7B which is mounted to the outer peripheral side of the casing 4. Herewith, the cooling fan 7 supplies cooling air to the orbiting bearing 9 or the like inside the casing 4 through the fan casing 7A and the duct 7B.

Reference numeral 8 denotes the orbiting scroll which is provided for orbit on the drive shaft 6 inside the casing 4. The orbiting scroll 8 comprises a disk-shaped metal plate 8A (hereinafter, referred to as end plate 8A), a wrap portion 8B which is spirally erected on the surface of the end plate 8A, and the coupling shaft portion 8C which projects from the center of the back surface (rear surface) of the end plate 8A and is rotatably mounted on the crank portion 6B of the drive shaft 6 via the orbiting bearing 9 centering on an axis line O2-O2. The orbiting scroll 8 is disposed inside the casing 4 so as to face the fixed scroll 11 (described hereinafter).

The center (the axis line O2-O2) of the coupling shaft portion 8C of the orbiting scroll 8 is formed eccentrically relative to the center (the axis line O1-O1) of the fixed scroll 11 (described hereinafter) in the radial direction by the predetermined dimension $\epsilon$1 (see FIG. 3). The orbiting scroll 8 orbits with an orbiting radius corresponding to the dimension $\epsilon$1 shown in FIG. 3 when the drive shaft 6 is rotated about the axis line O1-O1 by the electric motor 1.

First and second support member mount portions 10A and 10B for the ball coupling device 15 (described hereinafter) are provided in the orbiting scroll 8 at positions axially facing the support member mount portions 5A and 5B of the casing 4 on the back surface of the end plate 8A. Each of the first and second support member mount portions 10A and 10B is formed as a circular recess (a bottomed hole).

The first and second support member mount portions 10A and 10B are disposed with a space from each other in the radial direction of the orbiting scroll 8. As shown in FIGS. 3 to 6, a thrust support member 18 of the ball coupling mechanism 16 (described hereinafter) is fitted in the first support member mount portion 10A. A self-rotation suppressing support member 25 of the ball coupling mechanism 23 (described hereinafter) is fitted in the second support member mount portion 10B that is located on the outer side of the first support member mount portion 10A in the radial direction.

Reference numeral 11 denotes the fixed scroll which constitutes the fixed-side member of the compressor body 3 along with the casing 4. The fixed scroll 11 is fixed to the opening side of the casing 4 while facing the orbiting scroll 8, thereby closing the cylinder portion 4A of the casing 4 from one side in the axial direction.

The fixed scroll 11 comprises a disk-shaped end plate 11A which is disposed coaxially with the drive shaft 6, a wrap portion 11B which is spirally erected on the surface of the end plate 11A, and an annular flange portion 11C which is integrally provided with the outer peripheral side of the end plate 11A so as to enclose the wrap portion 11B and is mounted in abutment against the opening end side of the casing 4. Plurality of radiation fins 11D are erected on the rear surface side of the end plate 11A.

Reference numeral 12 denotes plurality of compression chambers as fluid chambers defined between the orbiting scroll 8 and the fixed scroll 11. Each of the compression chambers 12 compresses air as a fluid having compressibility between the two wrap portions 8B and 11B when the orbiting scroll 8 orbits.

That is, in the scroll compressor body 3, when the drive shaft 6 is rotationally driven, the orbiting scroll 8 orbits while its self-rotation on its axis is regulated by the ball coupling devices 15 (described hereinafter), thereby orbiting relative to the fixed scroll 11 with the orbiting radius corresponding to the dimension $\epsilon$1. Herewith, the compressor body 3 delivers air, which is sucked into the compression chambers 12 on the outer peripheral side from suction ports 13 (described hereinafter), to the center side while compressing the air sequentially in each of the compression chambers 12.

Reference numeral 13 denotes the plurality of suction ports provided on the outer peripheral side of the fixed scroll 11 (only one suction port is indicated by a dashed line in FIGS. 1 and 3). The suction ports 13 respectively communicate with the compression chambers 12 on the outer peripheral side, so that outside air is sucked into the compression chambers 12 through a suction silencer (not shown).

Reference numeral 14 denotes a discharge port provided on the center side of the fixed scroll 11. The discharge port 14 communicates with the compression chamber 12 on the center side. The discharge port 14 discharges the compressed air, which is compressed to have a higher pressure sequentially in each of the compression chambers 12 while being delivered from the outer peripheral side to the center side, from the center side compression chamber 12 to the outside.

Reference numeral 15 denotes the ball coupling device which is provided between the bottom portion 4B of the casing 4 and the back surface side of the orbiting scroll 8. The ball coupling device 15 comprises the first ball coupling mechanism 16 which supports a thrust load from the orbiting scroll 8 along the axis line O1-O1 (the axial direction), and the second ball coupling mechanism 23 which is provided with a space from the first ball coupling mechanism 16 to prevent the self-rotation of the orbiting scroll 8 on its axis.

Figure 2:
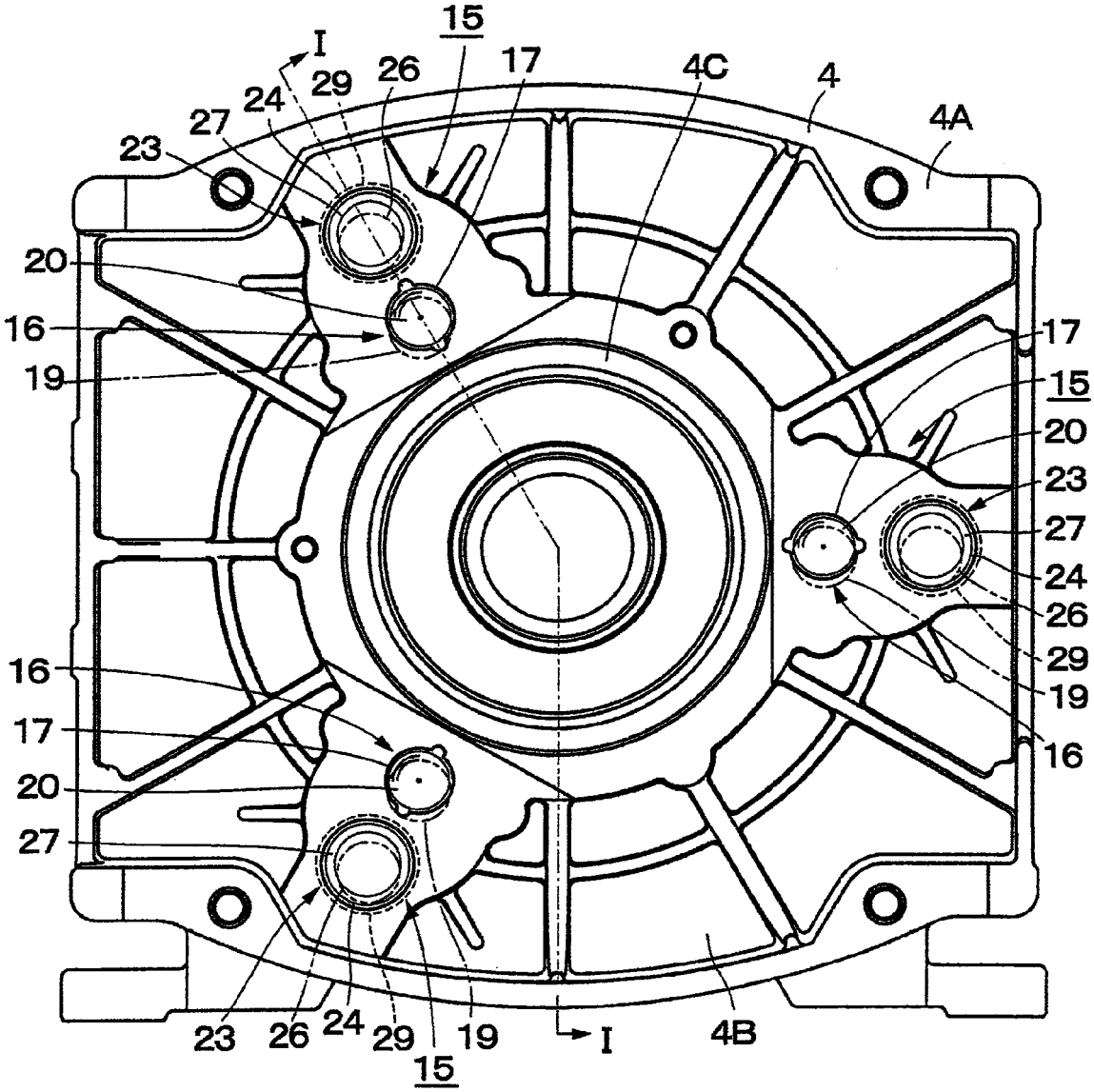
FIG. 2 is a right side view of a portion of a casing and ball coupling devices as viewed from the direction of an arrow II-II in FIG. 1.

For example, a total of three ball coupling devices 15, each having a set of the first ball coupling mechanism 16 and the second ball coupling mechanism 23, are provided as shown in FIG. 2. The three ball coupling devices 15 are disposed on the outer peripheral side of the bearing mount portion 4C, and are spaced at substantially regular intervals (at intervals of about 120 degrees) in the circumferential direction centering on the drive shaft 6 as shown in FIG. 2.

Figure 4:
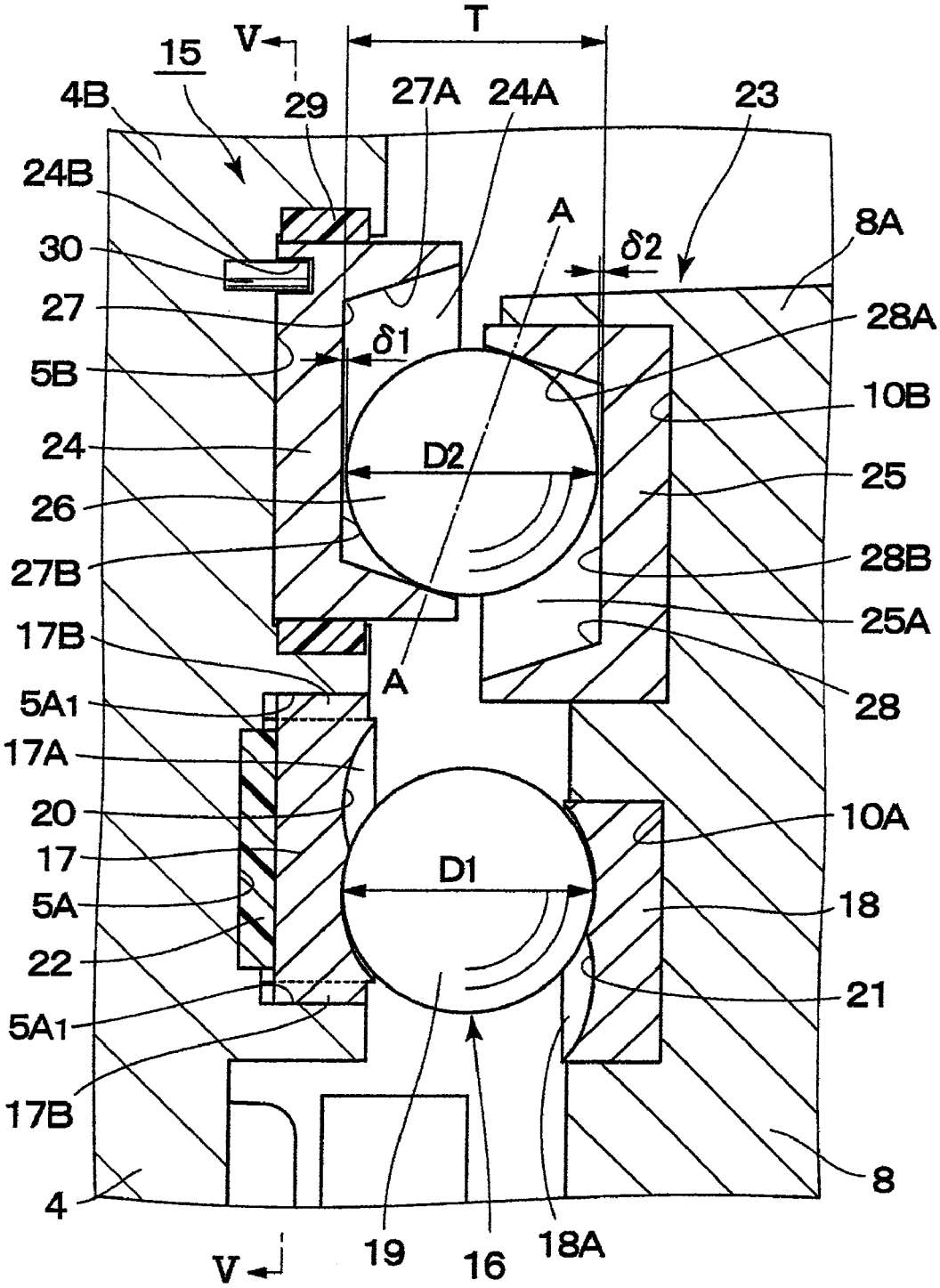
FIG. 4 is a further-enlarged detailed sectional view illustrating the ball coupling device in FIG. 3.

Reference numeral 16 denotes the first ball coupling mechanism which supports the thrust load. The first ball coupling mechanism 16 comprises the pair of thrust support members 17 and 18 provided facing each other in the casing 4 and the orbiting scroll 8, a spherical load supporting ball 19 held between the thrust support members 17 and 18 to receive the thrust load therebetween, and an elastic pad 22 (described hereinafter) as shown in FIG. 4. The thrust support members 17 and 18 respectively have ball support surfaces 17A and 18A facing each other via the load supporting ball 19 to receive the thrust load.

The load supporting ball 19 is formed as a spherical body having a diameter D1 that is made of material having high rigidity such as a steel ball. The load supporting ball 19 is disposed while being held between the ball support surfaces 17A and 18A (guide grooves 20 and 21 described hereinafter) of the thrust support members 17 and 18. The load supporting ball 19 receives the thrust load applied to the end plate 8A of the orbiting scroll 8 on the bottom portion 4B (the support member mount portion 5A) side of the casing 4 along with the thrust support members 17 and 18.

The thrust support member 17 (hereinafter, referred to as first thrust support member 17) of the casing 4 is formed as a disk-shaped plate by using hard material having high abrasion resistance, for example. The rotation preventing projections 17B and 17B are provided as rotation preventing means on the outer periphery of the first thrust support member 17. The first thrust support member 17 is fitted in the first support member mount portion 5A of the casing 4. The rotation preventing projections 17B are engaged with the rotation preventing grooves 5A1 of the support member mount portion 5A while the self-rotation on its axis is prevented.

Herewith, the movement of the first thrust support member 17 in a rotational direction is regulated with the rotation being prevented in the first support member mount portion 5A. However, when the elastic pad 22 (described hereinafter) is elastically deformed in a compression direction, the thrust support member 17 in the first support member mount portion 5A can be displaced in a direction in which the thrust load acts (the axial direction along the axis line O1-O1 in FIG. 3) along with the elastic deformation.

Meanwhile, the thrust support member 18 (hereinafter, referred to as second thrust support member 18) of the orbiting scroll 8 is formed as a disk-shaped plate by using the same material as that of the first thrust support member 17, for example. The second thrust support member 18 is fitted in the first support member mount portion 10A of the orbiting scroll 8 at a position axially facing the first thrust support member 17.

In this case, only one of the first and second thrust support members 17 and 18 needs to be axially displaceable for a reason described hereinafter. Thus, it is not necessary to provide the rotation preventing projections 17B in the second thrust support member 18 in a similar manner to the first thrust support member 17, for example. The second thrust support member 18 may be fixed to the support member mount portion 10A of the orbiting scroll 8 by fixing means such as press-fitting and an adhesive while the second thrust support member 18 is prevented from falling off and rotating.

The guide grooves 20 and 21, which are annular grooves, are respectively formed in the ball support surfaces 17A and 18A of the thrust support members 17 and 18. The guide grooves 20 and 21 are provided along a trace of a circle of the load supporting ball 19. That is, the guide grooves 20 and 21 guide the load supporting ball 19 for rolling by ensuring that the load supporting ball 19 rolls on a predetermined circle trace accompanying with the orbiting movement of the orbiting scroll 8.

To this end, each of the guide grooves 20 and 21 is formed in an arc shape in section at a contact position with the load supporting ball 19 such that the load supporting ball 19 is in smooth rolling-contact therewith on the both sides of the acting direction of the thrust load (the axial direction along the axis line O1-O1 in FIG. 3) as shown in FIG. 4. The radius of curvature of each of the guide grooves 20 and 21 in the section is set to a larger value than the radius (half the diameter D1) of the load supporting ball 19. Herewith, the guide grooves 20 and 21 can reduce a contact stress between the thrust support members 17 and 18 and the load supporting ball 19.

The guide grooves 20 and 21 are also formed shallow such that the groove depth is sufficiently smaller than the radius (half the diameter D1) of the load supporting ball 19. Therefore, the guide grooves 20 and 21 do not substantially come into contact with the load supporting ball 19 except a portion in the acting direction of the thrust load (the both ends in the axial direction). Thus, even when a force in a rotational direction (a rotational force) is applied to the orbiting scroll 8, the rotational force is substantially received by the second ball coupling mechanism 23 (described hereinafter), and does not substantially act on the first ball coupling mechanism 16.

Reference numeral 22 denotes the elastic pad which constitutes an elastic member provided in the first ball coupling mechanism 16. The elastic pad 22 is held between the support member mount portion 5A of the casing 4 and the first thrust support member 17 to elastically support the load supporting ball 19 in the direction of the thrust load. That is, the elastic pad 22 is elastically deformed between the support member mount portion 5A of the casing 4 and the first thrust support member 17 in the compression direction, thereby preventing an excess load from acting on the load supporting ball 19 as described hereinafter.

When K represents an elastic coefficient of the elastic pad 22, and δ1 and δ2 represent gap dimensions between the outer peripheral surface of a self-rotation preventing ball 26 (described hereinafter) and bottom surfaces 27B and 28B of recessed surfaces 27 and 28 of ball support surfaces 24A and 25A of the first and second self-rotation suppressing support members 24 and 25, an elastic force f of the elastic pad 22 is set to satisfy the following expression 1 with respect to a maximum thrust force F received by the orbiting scroll 8.

$$F<f=K\times(\delta 1+\delta 2) \quad \text{[Expression 1]}$$

Furthermore, when K1 represents an elastic coefficient of the load supporting ball 19, K2 represents an elastic coefficient of the thrust support members 17 and 18, K3 represents an elastic coefficient of the casing 4 and the orbiting scroll 8, and K4 represents an elastic coefficient of the elastic pad 22, each component is made of material such that the relationship among the elastic coefficients satisfies the following expression 2. For example, the load supporting ball 19 and the thrust support members 17 and 18 are made of bearing steel, the casing 4 and the orbiting scroll 8 are made of aluminum, and the elastic pad 22 is made of resin.

$$K1\approx K2>K3>K4 \quad \text{[Expression 2]}$$

Reference numeral 23 denotes the second ball coupling mechanism which prevents the self-rotation of the orbiting scroll 8. The second ball coupling mechanism 23 comprises the pair of self-rotation suppressing support members 24 and 25 provided facing each other in the casing 4 and the orbiting scroll 8, the self-rotation preventing ball 26 held between the self-rotation suppressing support members 24 and 25 to prevent the self-rotation of the orbiting scroll 8, and an elastic ring 29 (described hereinafter). The self-rotation suppressing support members 24 and 25 respectively have the ball support surfaces 24A and 25A facing each other via the self-rotation preventing ball 26 to prevent the self-rotation of the orbiting scroll 8.

The self-rotation suppressing support member 24 (hereinafter, referred to as first self-rotation suppressing support member 24) of the casing 4 is formed as a disk-shaped thick plate by using hard material having high abrasion resistance, for example. The elastic ring 29 (described hereinafter) is mounted with interference on the outer peripheral side of the first self-rotation suppressing support member 24 with no space. The first self-rotation suppressing support member 24 is fitted in the second support member mount portion 5B of the casing 4. The elastic ring 29 (described hereinafter) is interposed between the second support member mount portion 5B and the outer periphery of the self-rotation suppressing support member 24 in an elastically deformable manner.

A rotation preventing hole 24B having a small diameter is formed on the bottom side of the first self-rotation suppressing support member 24. A pin 30 (described hereinafter) is engaged with the rotation preventing hole 24B. Herewith, the movement of the first self-rotation suppressing support member 24 in a rotational direction is regulated with the rotation being prevented in the second support member mount portion 5B. However, when the elastic ring 29 (described hereinafter) is elastically deformed by the force in the rotational direction acting on the orbiting scroll 8, the self-rotation suppressing support member 24 can be radially displaced in the second support member mount portion 5B along with the elastic deformation.

Meanwhile, the self-rotation suppressing support member 25 (hereinafter, referred to as second self-rotation suppressing support member 25) of the orbiting scroll 8 is formed as a disk-shaped thick plate by using the same material as that of the first self-rotation suppressing support member 24, for example. The second self-rotation suppressing support member 25 is fitted in the second support member mount portion 10B of the orbiting scroll 8 at a position axially facing the first self-rotation suppressing support member 24.

In this case, the backlash occurring in the self-rotation preventing ball 26 in the rotational direction of the orbiting scroll 8 can be suppressed as long as the elastic ring 29 (described hereinafter) is provided on one of the first and second self-rotation suppressing support members 24 and 25. Thus, it is not necessary to form the rotation preventing hole 24B in the second self-rotation suppressing support member 25 in a similar manner to the first self-rotation suppressing support member 24, for example. The second self-rotation suppressing support member 25 may be fixed to the support member mount portion 10B of the orbiting scroll 8 by fixing means such as press-fitting and an adhesive while the second self-rotation suppressing support member 25 is prevented from falling off and rotating.

The recessed surfaces 27 and 28, each having a conical (a conical frustum) shape, are respectively provided in the ball support surfaces 24A and 25A of the first and second self-rotation suppressing support members 24 and 25. Inclined surfaces 27A and 28A, which are tapered peripheral walls inclined by a predetermined angle relative to the acting direction of the thrust load (the axial direction), and the circular bottom surfaces 27B and 28B constitute the recessed surfaces 27 and 28. The inclined surfaces 27A and 28A are widened in a taper shape from the bottom surfaces 27B and 28B toward the opening sides of the recessed surfaces 27 and 28.

The self-rotation preventing ball 26 is in rolling-contact with the inclined surfaces 27A and 28A of the recessed surfaces 27 and 28 on both ends in a direction inclined (for example, a direction along a virtual line A-A in FIG. 4) from the thrust load direction. The section at the contact position is formed in a linear shape. Therefore, the ball support surfaces 24A and 25A (the inclined surfaces 27A and 28A) of the self-rotation suppressing support members 24 and 25 can receive the force in a direction perpendicular to the thrust load direction, that is, in the rotational direction (the radial direction or the circumferential direction) of the orbiting scroll 8 with the self-rotation preventing ball 26 being held therebetween, thereby exerting a function of preventing the self-rotation of the orbiting scroll 8.

The inclined surfaces 27A and 28A of the recessed surfaces 27 and 28 guide the self-rotation preventing ball 26 along a predetermined circle trace accompanying with the orbiting movement of the orbiting scroll 8. In the self-rotation preventing ball 26, portions in rolling-contact with the inclined surfaces 27A and 28A, for example, correspond to an equator position perpendicular to the rotational axis of the sphere (the ball 26).

The self-rotation preventing ball 26 is formed as a spherical body by using hard material such as a steel ball in a similar manner to the load supporting ball 19. A diameter D2 of the self-rotation preventing ball 26 is formed equal to the diameter D1 of the load supporting ball 19 (D2=D1), for example.

However, the diameter D2 of the self-rotation preventing ball 26 is formed smaller than a distance dimension T between the bottom surfaces 27B and 28B of the recessed surfaces 27 and 28 (D2<T). Herewith, the outer peripheral surface (the spherical surface) of the self-rotation preventing ball 26 is disposed at a position apart by the dimensions 61 and 62 (minute gaps) from the bottom surfaces 27B and 28B of the recessed surfaces 27 and 28. The self-rotation preventing ball 26 is in rolling-contact with the inclined surfaces 27A and 28A of the recessed surfaces 27 and 28 in the direction along the virtual line A-A in FIG. 4, for example. The direction of the virtual line A-A is a direction inclined greatly (for example, a direction inclined within an angle range from 60 degrees to less than 90 degrees) relative to the thrust load direction (the axis line O1-O1 in FIG. 3).

As a result, the second ball coupling mechanism 23 can effectively receive the force in the rotational direction from the orbiting scroll 8, so that the thrust load from the orbiting scroll 8 hardly acts on the second ball coupling mechanism 23 (the inclined surfaces 27A and 28A of the self-rotation suppressing support members 24 and 25). The thrust load is received more effectively by the first ball coupling mechanism 16 than by the second ball coupling mechanism 23.

Reference numeral 29 denotes the elastic ring as an elastic member provided in the second ball coupling mechanism 23. The elastic ring 29 is formed as a short cylindrical body by using relatively hard elastic resin material or the like. The elastic ring 29 is elastically deformed in the radial direction with a larger deformation allowance than those of the metal members such as the casing 4 and the orbiting scroll 8. The elastic ring 29 has function to elastically support the self-rotation preventing ball 26 via the self-rotation suppressing support member 24 in a radially displaceable manner.

The elastic ring 29 is arranged between the second support member mount portion 5B and the outer periphery of the self-rotation suppressing support member 24 to enclose the entire outer periphery of the self-rotation suppressing support member 24. Even when the backlash occurs in the self-rotation preventing ball 26 in the rotational direction of the orbiting scroll 8 between the self-rotation suppressing support members 24 and 25 due to such reasons that the dimensional tolerance of each component is relaxed, for example, the elastic ring 29 can suppress the backlash by its elastic force (its elastic restoring force).

That is, the elastic ring 29 allows the self-rotation suppressing support member 24 to be relatively displaced in the radial direction within the second support member mount portion 5B by the elastic deformation of itself, and ensures that the self-rotation preventing ball 26 smoothly rolls (rolling-contacts) between the ball support surfaces 24A and 25A (the inclined surfaces 27A and 28A) of the self-rotation suppressing support members 24 and 25.

In this case, in the second ball coupling mechanism 23, the self-rotation preventing ball 26 rolls with an orbit radius corresponding to a dimension $\epsilon 2$ (see FIG. 6) between the self-rotation suppressing support members 24 and 25 when the orbiting scroll 8 orbits. That is, the self-rotation preventing ball 26 rolls with the orbit radius corresponding to the dimension $\epsilon 2$ between the self-rotation suppressing support members 24 and 25 when the self-rotation preventing ball 26 is in rolling-contact with the inclined surfaces 27A and 28A of the recessed surfaces 27 and 28 shown in FIG. 6. Meanwhile, an orbiting radius of the orbiting scroll 8 is determined by the dimension $\epsilon 1$ shown in FIG. 3.

In the second ball coupling mechanism 23, the orbit radius (the dimension $\epsilon 2$) of the self-rotation preventing ball 26 is set to be smaller than the orbiting radius (the dimension $\epsilon 1$) of the orbiting scroll 8 in advance as shown in the following expression 3. Herewith, the elastic ring 29 is elastically deformed in the radial direction by a dimension corresponding to a difference $\Delta\epsilon$ between the orbiting radius (the dimension $\epsilon 1$) of the orbiting scroll 8 and the orbit radius (the dimension $\epsilon 2$) of the self-rotation preventing ball 26 as shown in the following expression 4.

$$\epsilon 1 > \epsilon 2 \quad \text{[Expression 3]}$$

$$\Delta\epsilon = (\epsilon 1 - \epsilon 2) \quad \text{[Expression 4]}$$

Reference numeral 30 denotes the pin as another self-rotation preventing means provided in the second ball coupling mechanism 23. The pin 30 at a basilar end thereof is fixed to the bottom side of the support member mount portion 5B by means of embedding or the like as shown in FIG. 4, and the pin 30 at a top end thereof projects into the rotation preventing hole 24B of the self-rotation suppressing support member 24. The pin 30 is engaged with the rotation preventing hole 24B of the self-rotation suppressing support member 24, thereby holding the first self-rotation suppressing support member 24 with the rotation being prevented in the support member mount portion 5B.

A grease cover (not shown) may be provided in each of the first and second ball coupling mechanisms 16 and 23 so as to enclose the balls 19 and 26 from the outside. Herewith, grease as a lubricant can be easily held around the balls 19 and 26. Alternatively, the grease cover may enclose the entire ball coupling device 15.

The scroll air compressor according to the present embodiment has the aforementioned configuration. An operation thereof will be described hereinafter.

First, the electric motor 1 receives power supply from the outside to rotationally drive the drive shaft 6 about the axis line O1-O1 through the output shaft 2. The orbiting scroll 8 orbits with the predetermined orbiting radius (the dimension $\epsilon 1$ in FIG. 3) while its self-rotation on its axis is regulated by the three ball coupling devices 15, for example.

Herewith, each of the compression chambers 12 defined between the wrap portion 11B of the fixed scroll 11 and the wrap portion 8B of the orbiting scroll 8 is continuously reduced in volume from the outer peripheral side to the inner peripheral side of the scrolls. The outer peripheral side compression chambers 12 out of the above compression chambers 12 suck air from the suction ports 13 provided on the outer peripheral side of the fixed scroll 11. The air is continuously compressed in each of the compression chambers 12, and the compressed air is discharged from the inner peripheral side compression chamber 12 to the outside via the discharge port 14.

The pressure of the air compressed in each of the compression chambers 12 acts as the thrust load on the end plate 8A of the orbiting scroll 8 during the compression operation. As described above, the three ball coupling devices 15, for example, are arranged between the bottom portion 4B of the casing 4 and the back surface side of the orbiting scroll 8, and each of the ball coupling devices 15 separately includes the first ball coupling mechanism 16 and the second ball coupling mechanism 23.

The first ball coupling mechanism 16 can receive the thrust load applied to the end plate 8A of the orbiting scroll 8 by the first and second thrust support members 17 and 18 and the load supporting ball 19. Herewith, the first ball coupling mechanism 16 can stabilize the orbiting movement of the orbiting scroll 8 by preventing the orbiting scroll 8 from being displaced (misaligned) in the axial direction of the casing 4 or from being inclined relative to the fixed scroll 11.

Meanwhile, the second ball coupling mechanism 23 can receive the force in the rotational direction acting on the orbiting scroll 8 by the first and second self-rotation suppressing support members 24 and 25 and the self-rotation preventing ball 26. Herewith, the rotational force acting on the orbiting scroll 8 can be received and restrained by the second ball coupling mechanism 23 even in a large scroll fluid machine in which the orbiting scroll 8 has a larger inertia moment, and the behavior of the orbiting scroll 8 in the rotational direction can be stabilized, and a self-rotation preventing effect can be improved.

In each of the ball coupling devices 15 having the first and second ball coupling mechanisms 16 and 23, the function of supporting (receiving) the thrust load by the first ball coupling mechanism 16, and the function of preventing the rotation by the second ball coupling mechanism 23 can be separated from each other. Herewith, the design specifications of the first ball coupling mechanism 16 can be determined on the basis of only the magnitude of the thrust load, and the design specifications of the second ball coupling mechanism 23 can be determined on the basis of only the magnitude of the rotational force.

Furthermore, the second ball coupling mechanism 23 includes the elastic ring 29 located between the second support member mount portion 5B and the outer periphery of the self-rotation suppressing support member 24 to elastically support the self-rotation preventing ball 26 in the radial direction. In the second ball coupling mechanism 23, the orbit radius (the dimension $\epsilon 2$) of the self-rotation preventing ball 26 is set to be smaller than the orbiting radius (the dimension $\epsilon 1$) of the orbiting scroll 8 ($\epsilon 1 > \epsilon 2$) and the elastic ring 29 is elastically deformed in the radial direction by the dimension corresponding to the difference $\Delta\epsilon$ ($\Delta\epsilon = \epsilon 1 - \epsilon 2$) between the orbiting radius of the orbiting scroll 8 and the orbit radius of the self-rotation preventing ball 26.

Therefore, the dimensional tolerances of the components (for example, the self-rotation suppressing support members 24 and 25, and the self-rotation preventing ball 26) of the second ball coupling mechanism 23 can be relaxed. The backlash occurring in the self-rotation preventing ball 26 in the rotational direction of the orbiting scroll 8 between the self-rotation suppressing support members 24 and 25 can be suppressed by the elastic restoring force of the elastic ring 29 that is elastically deformed between the second support member mount portion 5B and the self-rotation suppressing support member 24.

That is, the elastic ring 29 allows the self-rotation suppressing support member 24 to be relatively displaced in the radial direction within the second support member mount portion 5B by its elastic deformation, and ensures that the self-rotation preventing ball 26 smoothly rolls (rolling-contacts) between the ball support surfaces 24A and 25A (the inclined surfaces 27A and 28A) of the self-rotation suppressing support members 24 and 25.

As described above, according to the present embodiment, each component of the second ball coupling mechanism 23 can be produced without processing the components with high accuracy. Even when the components are formed by relaxing the dimensional tolerances, the backlash occurring in the self-rotation preventing ball 26 in the rotational direction of the orbiting scroll 8 between the self-rotation suppressing support members 24 and 25 can be prevented by the elastic ring 29. Herewith, the second ball coupling mechanism 23 can stabilize the behavior of the orbiting scroll 8 in the rotational direction and allow the orbiting scroll 8 to smoothly orbit.

Furthermore, since the elastic ring 29 provided in the second ball coupling mechanism 23 elastically supports the self-rotation preventing ball 26 in the radial direction, the backlash between the self-rotation suppressing support members 24 and 25 and the self-rotation preventing ball 26 can be absorbed and the adverse effect of the backlash can be prevented from affecting the first ball coupling mechanism 16. As a result, the load supporting ball 19 is prevented from sliding along the ball support surfaces 17A and 18A on which the load supporting ball 19 rolls, thereby preventing abrasion, damage or the like.

The self-rotation preventing ball 26 of the second ball coupling mechanism 23 is in rolling-contact with the inclined surfaces 27A and 28A of the self-rotation suppressing support members 24 and 25 on the both ends in the direction along the virtual line A-A in FIG. 4, for example. Therefore, the load acting between the self-rotation preventing ball 26 and the inclined surfaces 27A and 28A can be resolved into a load component in the axial direction along the thrust load direction (the axis line O1-O1 in FIG. 3) and a load component in the radial direction perpendicular thereto.

The virtual line A-A in FIG. 4 is inclined greatly relative to the thrust load direction as described above, and therefore, the load component in the radial direction acts as a larger load than the load component in the axial direction. However, in this case, the elastic ring 29 is elastically deformed between the support member mount portion 5B and the self-rotation suppressing support member 24, thereby absorbing the load component in the radial direction. Accordingly, it is possible that the load component in the radial direction affects the first ball coupling mechanism 16.

On the other hand, there is possibility that the load component in the axial direction may affect the first ball coupling mechanism 16. The load component in the axial direction on the second ball coupling mechanism 23, however, can be absorbed by the elastic pad 22 provided in the first ball coupling mechanism 16, thereby preventing an excess load from acting on the load supporting ball 19.

To be more specific, the elastic pad 22 held between the support member mount portion 5A and the first thrust support member 17 of the casing 4 elastically supports the load supporting ball 19 in the direction of the thrust load (the direction along the axis line O1-O1 in FIG. 3), thereby preventing the load component in the axial direction from becoming the excess load and acting on, for example, the thrust support member 17 and the load supporting ball 19.

Therefore, according to the present embodiment, the dimensional tolerances of the first and second ball coupling mechanisms 16 and 23 can be relaxed in comparison with a case in which the two functions of supporting the thrust load on the orbiting scroll 8 and preventing the self-rotation thereof are combined (for example, the case of the related art). The ball support surfaces 17A and 18A of the thrust support members 17 and 18 and the ball support surfaces 24A and 25A of the self-rotation suppressing support members 24 and 25 can be thereby formed into relatively simple shapes as the rolling surfaces with respect to the balls 19 and 26.

Accordingly, the ball support surfaces 17A and 18A of the thrust support members 17 and 18 and the ball support surfaces 24A and 25A of the self-rotation suppressing support members 24 and 25 do not need to be processed with particularly high accuracy and can be relatively easily processed. The product yield can be thereby improved, and the production cost and management cost can be reduced.

In the second ball coupling mechanism 23, the self-rotation preventing ball 26 is in rolling-contact with the inclined surfaces 27A and 28A of the self-rotation suppressing support members 24 and 25 in the direction along the virtual line A-A (see FIG. 4). Thus, the second ball coupling mechanism 23 can effectively receive the force in the rotational direction from the orbiting scroll 8, and the thrust load acting on the second ball coupling mechanism 23 (the inclined surfaces 27A and 28A of the self-rotation suppressing support members 24 and 25) from the orbiting scroll 8 can be suppressed small. The thrust load can be received more effectively by the first ball coupling mechanism 16 than by the second ball coupling mechanism 23.

In the first ball coupling mechanism 16, the guide grooves 20 and 21 (the groove depth) of the thrust support members 17 and 18 are formed shallow such that the groove depth is sufficiently smaller than the radius (half the diameter D1) of the load supporting ball 19, and the guide grooves 20 and 21 do not substantially come into contact with the load supporting ball 19 except the portions in the acting direction of the thrust load (the both ends in the axial direction). Thus, even when the force in the rotational direction (the rotational force) is applied to the orbiting scroll 8, the rotational force can be substantially received by the second ball coupling mechanism 23, and the rotational force can be prevented from acting on the first ball coupling mechanism 16.

As described above, as for the rotational force acting on the orbiting scroll 8, the second ball coupling mechanism 23 receives a larger rotational force than the first ball coupling mechanism 16. Accordingly, the rotational force on the orbiting scroll 8 can be stably supported by the second ball coupling mechanism 23, and the effect of the rotational force acting on the first ball coupling mechanism 16 can be reduced.

Also, as for the thrust load acting on the orbiting scroll 8, the first ball coupling mechanism 16 supports a larger thrust load than the second ball coupling mechanism 23. Accordingly, the thrust load can be reliably supported by the first ball coupling mechanism 16, and the effect of the thrust load acting on the second ball coupling mechanism 23 can be suppressed small.

Problems occurring due to a temperature difference, a thermal expansion difference or the like between the casing 4 and the orbiting scroll 8 during the compression operation can be also absorbed by the elastic deformation of the elastic ring 29, thereby stabilizing the function of preventing the rotation by the second ball coupling mechanism 23 and stabilizing the function of supporting the thrust load by the first ball coupling mechanism 16. Accordingly, the apparatus becomes more reliable.

Meanwhile, each of the ball coupling devices 15 having the first and second ball coupling mechanisms 16 and 23 can hold a lubricant such as grease in each of the first and second ball coupling mechanisms 16 and 23. Therefore, the lubricant can be easily held in comparison with a case in which the entire ball coupling device is sealed as in the related art.

Each of the ball coupling devices 15 includes the first and second ball coupling mechanisms 16 and 23, separately. The load supporting ball 19 is in rolling-contact with the thrust support members 17 and 18, and the self-rotation preventing ball 26 is in rolling-contact with the self-rotation suppressing support members 24 and 25. Therefore, power loss can be considerably reduced in comparison with a mechanism for preventing the self-rotation of the orbiting scroll by bringing a guide and a slider into sliding contact with each other such as an Oldham coupling.

The three sets of the first and second ball coupling mechanisms 16 and 23 are disposed at intervals in the circumferential direction on the outer peripheral side of the orbiting scroll 8. Therefore, the orbiting scroll 8 can be stably supported at the three positions by using the three sets of the ball coupling mechanisms 16 and 23, and the backlash in the thrust direction and the rotational direction (the circumferential direction) does not occur in the orbiting scroll 8. Since the three ball coupling devices 15 are disposed at intervals in the circumferential direction, the cooling air can be supplied to the orbiting bearing 9 or the like through a space between the two adjacent ball coupling devices 15, thereby improving a cooling effect.

Since the guide grooves 20 and 21 are provided in the ball support surfaces 17A and 18A of the pair of thrust support members 17 and 18, the thrust load can be smoothly supported by bringing the load supporting ball 19 into rolling-contact with the guide grooves 20 and 21 on the both ends along the thrust load direction. The guide grooves 20 and 21 are also formed as shallow annular grooves, each having an arc shape in section. Therefore, the guide grooves 20 and 21 can reduce the contact stress generated when the load supporting ball 19 comes into contact with the guide grooves 20 and 21 in comparison with a case in which the section is formed in a linear shape. The operating life of the first ball coupling mechanism 16 can be thereby extended.

Furthermore, the first and second ball coupling mechanisms 16 and 23 are disposed with a space from each other in the radial direction of the orbiting scroll 8. Therefore, in comparison with a case in which the first and second ball coupling mechanisms 16 and 23 are disposed with a space from each other in the circumferential direction, for example, more sets of the first and second ball coupling mechanisms 16 and 23 can be arranged in the circumferential direction. Herewith, the thrust load and the rotational force acting on each set of the first and second ball coupling mechanisms 16 and 23 can be reduced, thereby extending the operating life of each of the ball coupling mechanisms 16 and 23.

Figure 7:
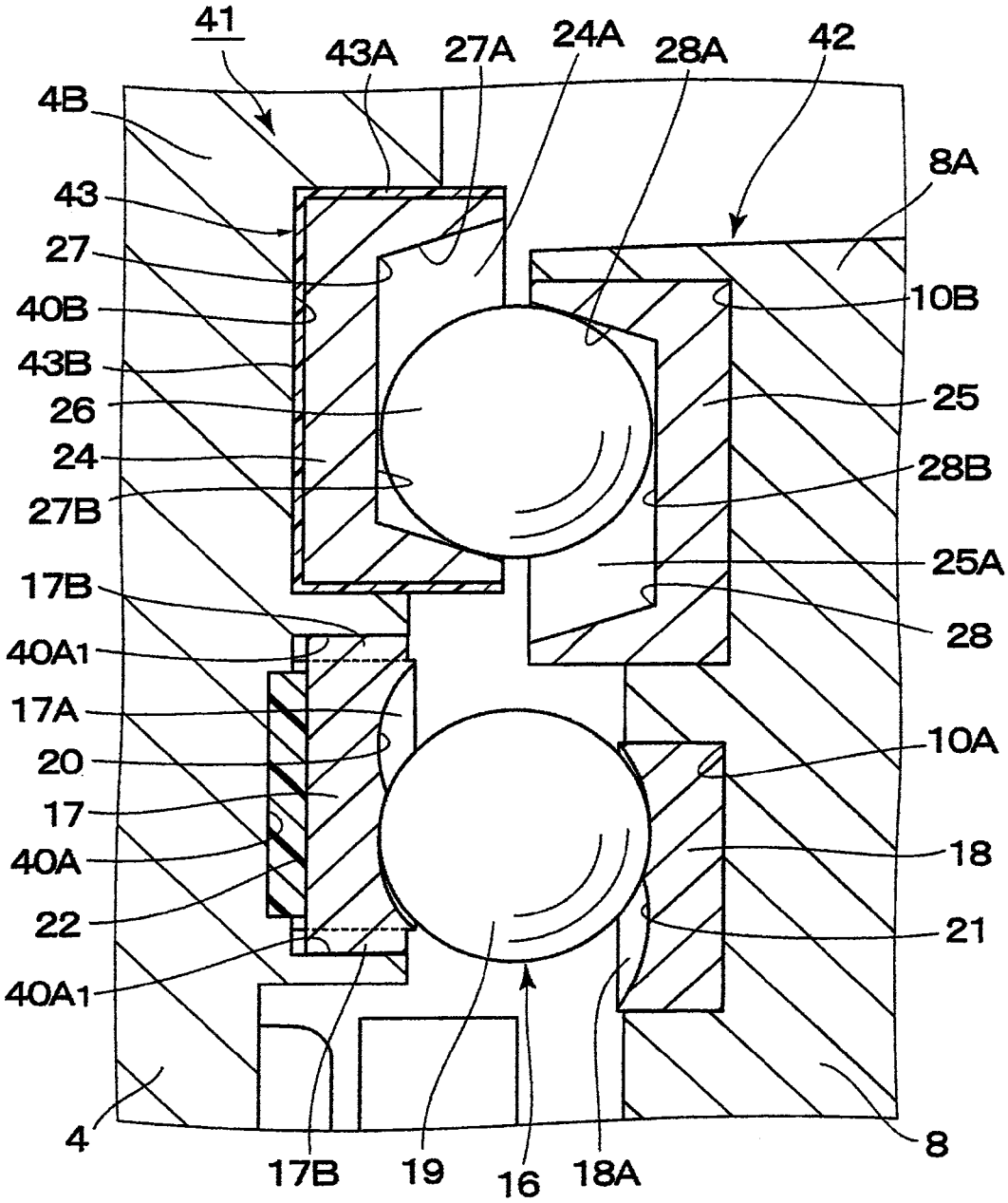
FIG. 7 is a detailed sectional view illustrating a ball coupling device according to a second embodiment.

FIG. 7 illustrates a second embodiment according to the present invention. The second embodiment is characterized in that the elastic member provided in the second ball coupling mechanism is formed as a bottomed cylindrical body, to elastically support one of the self-rotation suppressing support members from the outer side in the radial direction and one side (the back surface side) in the axial direction. In the present embodiment, the same components as those in the aforementioned first embodiment are assigned the same reference numerals, and the description thereof is omitted.

In FIG. 7, reference numerals 40A and 40B denote first and second support member mount portions employed in the present embodiment. The first and second support member mount portions 40A and 40B have substantially the same configurations as those of the first and second support member mount portions 5A and 5B described in the first embodiment. The first and second support member mount portions 40A and 40B are formed as circular recesses (bottomed holes) in the bottom portion 4B of the casing 4. Pair of rotation preventing grooves 40A1 and 40A1, which are recessed grooves with small diameters, are formed in the peripheral wall of the first support member mount portion 40A.

The thrust support member 17 of the first ball coupling mechanism 16 is fitted in the first support member mount portion 40A in a similar manner to the first embodiment. The rotation preventing projections 17B are respectively engaged with the rotation preventing grooves 40A1 of the support member mount portion 40A, so that the rotation of the thrust support member 17 is prevented in the first support member mount portion 40A.

Meanwhile, the second support member mount portion 40B is formed as a bottomed hole having a larger diameter than that of the first support member mount portion 40A. The self-rotation suppressing support member 24 of a second ball coupling mechanism 42 (described hereinafter) is fitted in the second support member mount portion 40B along with an elastic cylinder body 43.

Reference numeral 41 denotes a ball coupling device employed in the present embodiment. The ball coupling device 41 has the same configuration as that of the ball coupling device 15 described in the first embodiment, and includes the first ball coupling mechanism 16 and the second ball coupling mechanism 42. The second ball coupling mechanism 42 has the same configuration as that of the second ball coupling mechanism 23 described in the first embodiment except for the elastic cylinder body 43 (described hereinafter).

To be more specific, the second ball coupling mechanism 42 includes the self-rotation suppressing support members 24 and 25 and the self-rotation preventing ball 26 in a similar manner to the second ball coupling mechanism 23 described in the first embodiment. The ball support surfaces 24A and 25A of the self-rotation suppressing support members 24 and 25 include the conical (conical frustum) shaped recessed surfaces 27 and 28 composed of the inclined surfaces 27A and 28A formed as the tapered peripheral walls and the circular bottom surfaces 27B and 28B.

Reference numeral 43 denotes the elastic cylinder body as the elastic member provided in the second ball coupling mechanism 42. The elastic cylinder body 43 is formed as a bottomed cylindrical body by using the same elastic resin material as that of the elastic ring 29 described in the first embodiment, for example. The elastic cylinder body 43 elastically supports the self-rotation preventing ball 26 via the self-rotation suppressing support member 24 in a radially and axially displaceable manner.

The elastic cylinder body 43 includes a cylinder portion 43A provided between the second support member mount portion 40B and the outer periphery of the self-rotation suppressing support member 24 to enclose the entire outer periphery of the self-rotation suppressing support member 24, and a circular bottom portion 43B provided between the back surface of the self-rotation suppressing support member 24 and the bottom surface of the support member mount portion 40B.

Even when the backlash occurs in the self-rotation preventing ball 26 in the rotational direction of the orbiting scroll 8 between the self-rotation suppressing support members 24 and 25, the elastic cylinder body 43 can suppress the backlash by the elastic restoring force in a similar manner to the elastic ring 29 described in the first embodiment. Furthermore, since the elastic cylinder body 43 has the bottom portion 43B as well as the cylinder portion 43A, the elastic cylinder body 43 allows the self-rotation suppressing support member 24 to be relatively displaced in the radial and axial directions within the second support member mount portion 40B by the elastic deformation of the cylinder portion 43A and the bottom portion 43B, and ensures that the self-rotation preventing ball 26 smoothly rolls on the ball support surfaces 24A and 25A (the inclined surfaces 27A and 28A) of the self-rotation suppressing support members 24 and 25.

The cylinder portion 43A and the bottom portion 43B of the elastic cylinder body 43 do not always need to be formed integrally with each other, and may be also formed as separate members. The pin 30 (not shown in FIG. 7) as the self-rotation preventing means may be also provided between the self-rotation suppressing support member 24 and the support member mount portion 40B to hold the self-rotation suppressing support member 24 with the rotation being prevented in the support member mount portion 40B in a similar manner to the first embodiment shown in FIG. 4.

In the present embodiment which has the aforementioned configuration, substantially the same effects as those of the aforementioned first embodiment can be also obtained by providing the elastic cylinder body 43 between the self-rotation suppressing support member 24 and the second support member mount portion 40B. Furthermore, in the present embodiment, the elastic cylinder body 43 includes the cylinder portion 43A and the bottom portion 43B.

Therefore, the cylinder portion 43A allows the self-rotation suppressing support member 24 to be relatively displaced in the radial direction within the second support member mount portion 40B, and the bottom portion 43B allows the self-rotation suppressing support member 24 to be relatively displaced in the axial direction within the second support member mount portion 40B by the elastic compression deformation.

Figure 8:
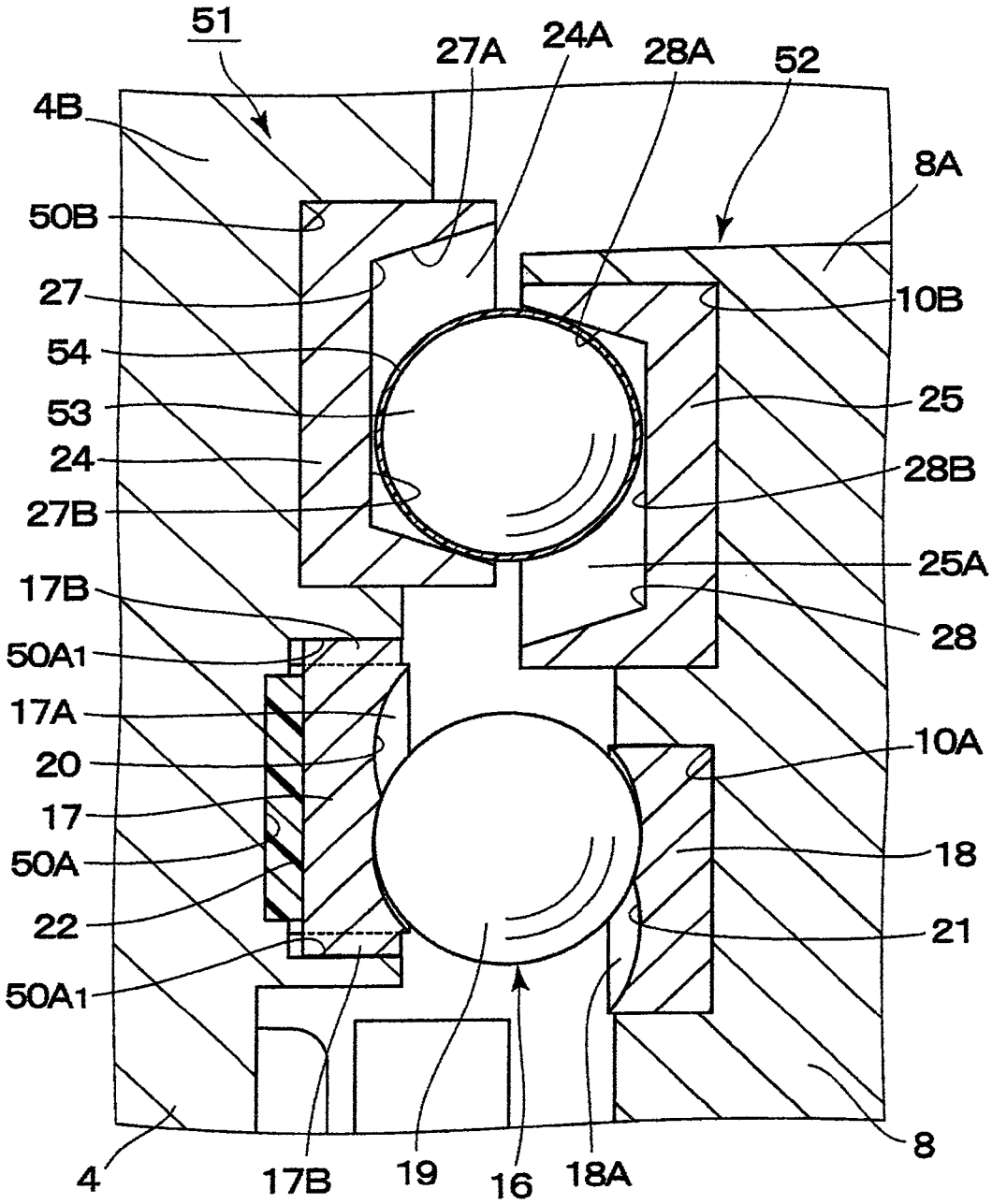
FIG. 8 is a detailed sectional view illustrating a ball coupling device according to a third embodiment.

FIG. 8 illustrates a third embodiment according to the present invention. The third embodiment is characterized in that an elastic film is provided as the elastic member on an outer periphery of the self-rotation preventing ball. In the present embodiment, the same components as those in the aforementioned first embodiment are assigned the same reference numerals, and the description thereof is omitted.

In FIG. 8, reference numerals 50A and 50B denote first and second support member mount portions employed in the present embodiment. The first and second support member mount portions 5A and 50B have substantially the same configurations as those of the first and second support member mount portions 5A and 5B described in the first embodiment. Pair of rotation preventing grooves 50A1 and 50A1, which are recessed grooves with small diameters, are formed in the peripheral wall of the first support member mount portion 50A.

The thrust support member 17 of the first ball coupling mechanism 16 is fitted in the first support member mount portion 50A in a similar manner to the first embodiment. The rotation preventing projections 17B are respectively engaged with the rotation preventing grooves 50A1 of the support member mount portion 50A, so that the rotation of the thrust support member 17 is prevented in the first support member mount portion 50A.

Meanwhile, the second support member mount portion 50B is formed as a bottomed hole having a larger diameter than that of the first support member mount portion 50A. The self-rotation suppressing support member 24 of a second ball coupling mechanism 52 (described hereinafter) is directly fitted in the second support member mount portion 50B. Herewith, the self-rotation suppressing support member 24 is fixed to the support member mount portion 50B while the self-rotation suppressing support member 24 is prevented from falling off and rotating.

Reference numeral 51 denotes a ball coupling device employed in the present embodiment. The ball coupling device 51 has the same configuration as that of the ball coupling device 15 described in the first embodiment, and includes the first ball coupling mechanism 16 and the second ball coupling mechanism 52. The second ball coupling mechanism 52 has substantially the same configuration as that of the second ball coupling mechanism 23 described in the first embodiment.

To be more specific, the second ball coupling mechanism 52 includes the self-rotation suppressing support members 24 and 25 in a similar manner to the second ball coupling mechanism 23 described in the first embodiment. The ball support surfaces 24A and 25A of the self-rotation suppressing support members 24 and 25 include the conical (conical frustum) shaped recessed surfaces 27 and 28 composed of the inclined surfaces 27A and 28A formed as the tapered peripheral walls and the circular bottom surfaces 27B and 28B. However, the second ball coupling mechanism 52 is different from that of the first embodiment in that an elastic film 54 is provided on a self-rotation preventing ball 53 (described hereinafter).

Reference numeral 53 denotes the self-rotation preventing ball which constitutes a part of the second ball coupling mechanism 52. The self-rotation preventing ball 53 has substantially the same configuration as that of the self-rotation preventing ball 26 described in the first embodiment. In this case, however, the elastic film 54 (described hereinafter) is provided on the self-rotation preventing ball 53 with a predetermined film thickness.

Reference numeral 54 denotes the elastic film as the elastic member employed in the present embodiment. The elastic film 54 is made of the same elastic resin material as that of the elastic ring 29 described in the first embodiment, for example. The elastic film 54 covers the self-rotation preventing ball 53. The elastic film 54 is disposed while being held between the ball support surfaces 24A and 25A of the self-rotation suppressing support members 24 and 25 to come into contact with the ball support surfaces 24A and 25A (the inclined surfaces 27A and 28A) along with the self-rotation preventing ball 53.

That is, the elastic film 54 elastically supports the self-rotation preventing ball 53 between the self-rotation suppressing support members 24 and 25 in a displaceable manner in the radial direction by enclosing the entire outer periphery of the self-rotation preventing ball 53. The elastic film 54 suppresses the backlash occurring in the self-rotation preventing ball 53 in the rotational direction of the orbiting scroll 8 between the self-rotation suppressing support members 24 and 25, and ensures that the self-rotation preventing ball 53 smoothly rolls on the ball support surfaces 24A and 25A (the inclined surfaces 27A and 28A) of the self-rotation suppressing support members 24 and 25.

In the present embodiment having the aforementioned configuration, it is possible to obtain substantially the same effects as those of the aforementioned first embodiment. In particular, in the present embodiment, the self-rotation preventing ball 53 is covered by the elastic film 54 as the elastic member. Therefore, the backlash of the self-rotation preventing ball 53 between the self-rotation suppressing support members 24 and 25 can be directly absorbed by the elastic film 54.

Figure 9:
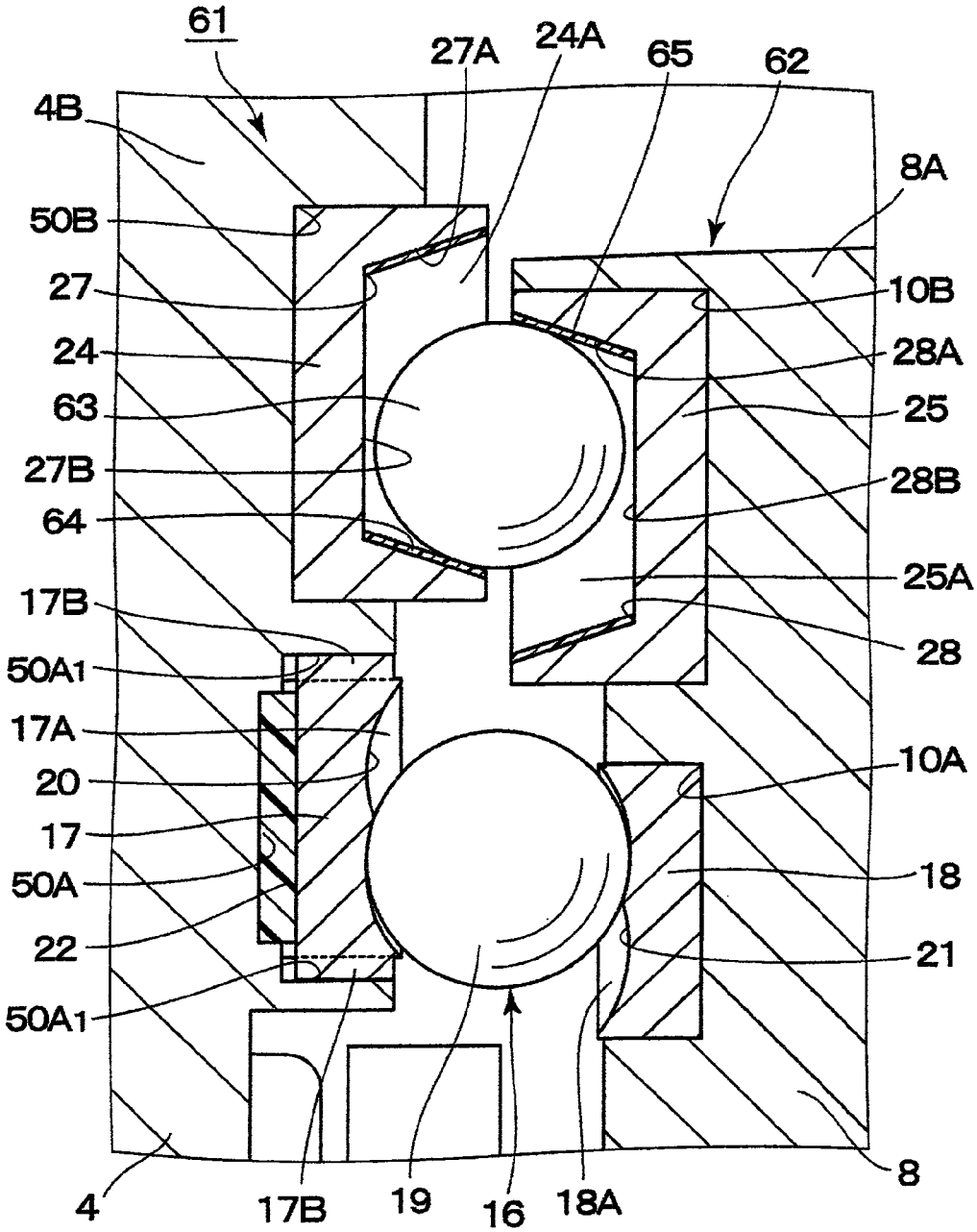
FIG. 9 is a detailed sectional view illustrating a ball coupling device according to a fourth embodiment.

FIG. 9 illustrates a fourth embodiment according to the present invention. The fourth embodiment is characterized in that the elastic member is provided on the ball support surfaces of the self-rotation suppressing support members. In the present embodiment, the same components as those in the aforementioned third embodiment are assigned the same reference numerals, and the description thereof is omitted.

In FIG. 9, reference numeral 61 denotes a ball coupling device employed in the present embodiment. The ball coupling device 61 has the same configuration as that of the ball coupling device 51 described in the third embodiment, and includes the first ball coupling mechanism 16 and a second ball coupling mechanism 62.

The second ball coupling mechanism 62 includes the self-rotation suppressing support members 24 and 25. The ball support surfaces 24A and 25A of the self-rotation suppressing support members 24 and 25 include the recessed surfaces 27 and 28 composed of the inclined surfaces 27A and 28A and the bottom surfaces 27B and 28B. However, the second ball coupling mechanism 62 is different from that of the third embodiment in that elastic films 64 and 65 (described hereinafter) are provided on the inclined surfaces 27A and 28A of the recessed surfaces 27 and 28.

Reference numeral 63 denotes a self-rotation preventing ball which constitutes a part of the second ball coupling mechanism 62. The self-rotation preventing ball 63 has substantially the same configuration as that of the self-rotation preventing ball 26 described in the first embodiment. In this case, however, the self-rotation preventing ball 63 is different from that of the above embodiment in that the self-rotation preventing ball 63 abuts (comes into contact with) against the inclined surfaces 27A and 28A of the self-rotation suppressing support members 24 and 25 via the elastic films 64 and 65 (described hereinafter).

Reference numerals 64 and 65 denote the elastic films as the elastic member employed in the present embodiment. The elastic films 64 and 65 are made of the same elastic resin material as that of the elastic ring 29 described in the first embodiment, for example. The first elastic film 64 covers the inclined surface 27A of the recessed surface 27 over the entire periphery. The second elastic film 65 covers the inclined surface 28A of the recessed surface 28 over the entire periphery.

The self-rotation preventing ball 63 in this case is disposed while being held between the ball support surfaces 24A and 25A of the self-rotation suppressing support members 24 and 25 to abut against the ball support surfaces 24A and 25A (the inclined surfaces 27A and 28A) so as to be in rolling-contact therewith via the elastic films 64 and 65.

That is, the elastic films 64 and 65 cover the inclined surfaces 27A and 28A of the self-rotation suppressing support members 24 and 25 over the entire peripheries, thereby elastically supporting the self-rotation preventing ball 63 between the self-rotation suppressing support members 24 and 25 in a displaceable manner in the radial direction and the like. The elastic films 64 and 65 suppress the backlash occurring in the self-rotation preventing ball 63 in the rotational direction of the orbiting scroll 8 between the self-rotation suppressing support members 24 and 25, and ensure that the self-rotation preventing ball 63 smoothly rolls on the ball support surfaces 24A and 25A (the inclined surfaces 27A and 28A) of the self-rotation suppressing support members 24 and 25.

In the present embodiment having the aforementioned configuration, it is possible to obtain substantially the same effects as those of the aforementioned third embodiment. In particular, in the present embodiment, the elastic films 64 and 65 cover the inclined surfaces 27A and 28A of the self-rotation suppressing support members 24 and 25 over the entire peripheries and therefore, the self-rotation preventing ball 63 can be elastically supported between the self-rotation suppressing support members 24 and 25 in a displaceable manner in the radial direction and the like.

In the aforementioned fourth embodiment, the case in which the elastic films 64 and 65 are provided on the inclined surfaces 27A and 28A of the self-rotation suppressing support members 24 and 25 is described. However, the present invention is not limited to the case. For example, as long as the elastic film is provided on one of the inclined surfaces 27A and 28A (the ball support surfaces) of the self-rotation suppressing support members 24 and 25, it is not necessary to provide the elastic film on the other inclined surface. In this case, substantially the same effects as those of the aforementioned fourth embodiment can be also obtained.

Figure 10:
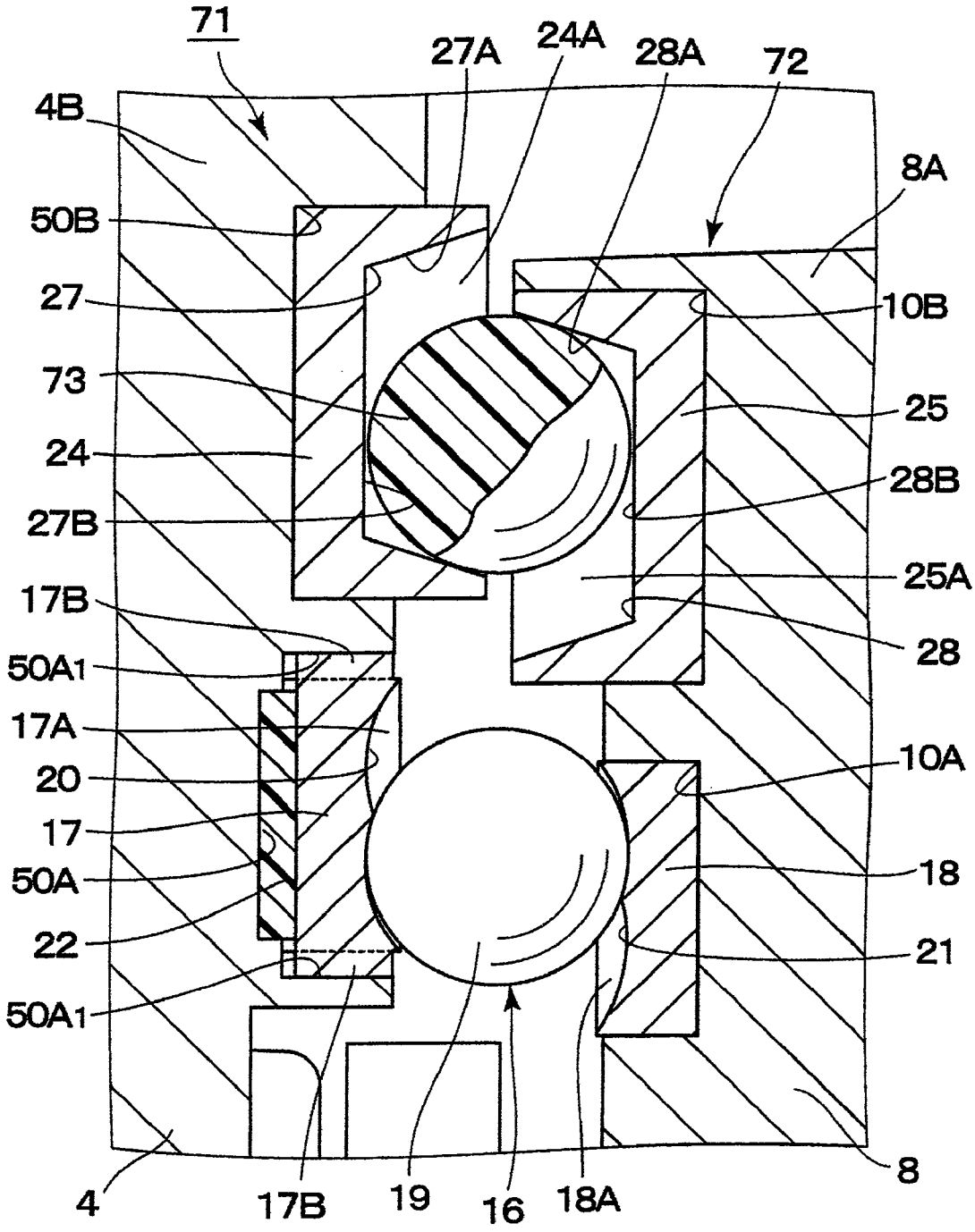
FIG. 10 is a detailed sectional view illustrating a ball coupling device according to a fifth embodiment.

FIG. 10 illustrates a fifth embodiment according to the present invention. The fifth embodiment is characterized in that the self-rotation preventing ball itself is formed of a spherical elastic member. In the present embodiment, the same components as those in the aforementioned third embodiment are assigned the same reference numerals, and the description thereof is omitted.

In FIG. 10, reference numeral 71 denotes a ball coupling device employed in the present embodiment. The ball coupling device 71 has the same configuration as that of the ball coupling device 51 described in the third embodiment, and includes the first ball coupling mechanism 16 and a second ball coupling mechanism 72.

The second ball coupling mechanism 72 includes the self-rotation suppressing support members 24 and 25. The ball support surfaces 24A and 25A of the self-rotation suppressing support members 24 and 25 include the recessed surfaces 27 and 28 composed of the inclined surfaces 27A and 28A and the bottom surfaces 27B and 28B. However, the second ball coupling mechanism 72 is different from that of the third embodiment in that a self-rotation preventing ball 73 (described hereinafter) is formed as a spherical elastic body.

Reference numeral 73 denotes the self-rotation preventing ball which constitutes a part of the second ball coupling mechanism 72. The self-rotation preventing ball 73 has substantially the same configuration as that of the self-rotation preventing ball 26 described in the first embodiment. In this case, however, the self-rotation preventing ball 73 is different from those of the aforementioned respective embodiments in that the self-rotation preventing ball 73 is formed as a spherical elastic member (elastic body) by using the same elastic resin material as that of the elastic ring 29 described in the first embodiment, for example.

The self-rotation preventing ball 73 in this case is disposed while being held between the ball support surfaces 24A and 25A of the self-rotation suppressing support members 24 and 25, and is elastically supported in a displaceable manner in the radial direction and the like with respect to the ball support surfaces 24A and 25A (the inclined surfaces 27A and 28A). Herewith, the backlash occurring in the self-rotation preventing ball 73 in the rotational direction of the orbiting scroll 8 between the self-rotation suppressing support members 24 and 25 is suppressed, and the self-rotation preventing ball 73 smoothly rolls on the ball support surfaces 24A and 25A (the inclined surfaces 27A and 28A) of the self-rotation suppressing support members 24 and 25.

In the present embodiment having the aforementioned configuration, it is possible to obtain substantially the same effects as those of the first embodiment. In particular, in the present embodiment, the self-rotation preventing ball 73 is formed as a spherical elastic body. Therefore, it is not necessary to separately form the elastic member, for example. The number of components can be thereby reduced and operability during assembling can be improved.

Figure 11:
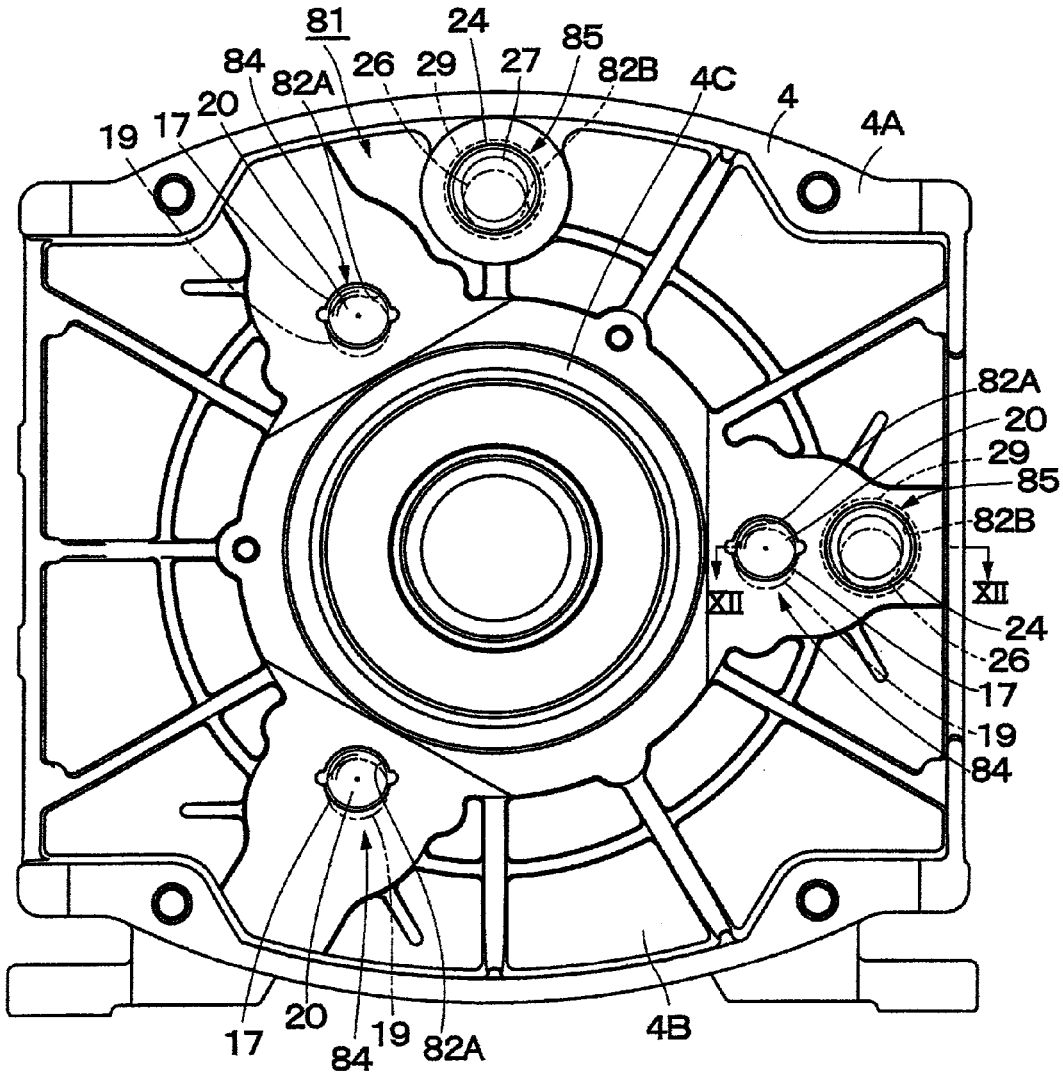
FIG. 11 is a right side view of a portion of a casing and ball coupling devices according to a sixth embodiment as viewed from the same position as that in FIG. 2.
Figure 12:
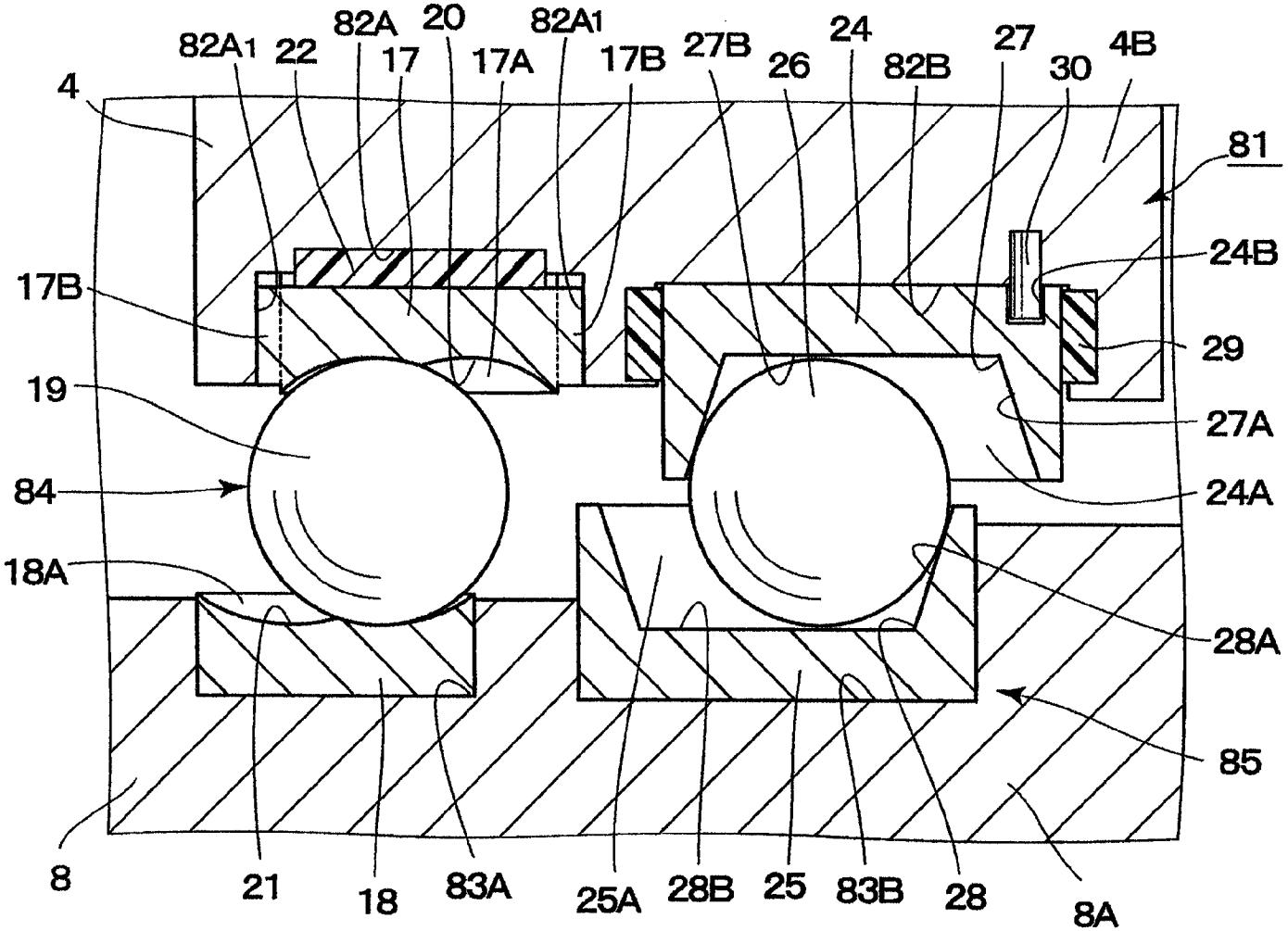
FIG. 12 is a detailed sectional view of a ball coupling device as viewed from the direction of an arrow XII-XII in FIG. 11.

FIGS. 11 and 12 illustrate a sixth embodiment according to the present invention. The present embodiment is characterized in that the first ball coupling mechanism is disposed at three positions at intervals in the circumferential direction of the orbiting scroll and the second ball coupling mechanism is disposed at two positions at an interval in the circumferential direction of the orbiting scroll so as not to be located on a line passing through the center position of the orbiting scroll. In the present embodiment, the same components as those in the aforementioned first embodiment are assigned the same reference numerals, and the description thereof is omitted.

In FIGS. 11 and 12, reference numeral 81 denotes a ball coupling device employed in the present embodiment. The ball coupling device 81 has substantially the same configuration as that of the ball coupling device 15 described in the first embodiment, and includes a first ball coupling mechanism 84 and a second ball coupling mechanism 85 (described hereinafter). In this case, however, the ball coupling device 81 is different in that a total of three first ball coupling mechanisms 84 and a total of two second ball coupling mechanisms 85 are provided.

First and second support member mount portions 82A and 82B are formed as circular recesses (bottomed holes) in the bottom portion 4B of the casing 4 in a substantially similar manner to the first and second support member mount portions 5A and 5B described in the first embodiment. However, the first support member mount portion 82A is disposed at three positions at intervals in the circumferential direction of the casing 4, and the second support member mount portion 82B is disposed at two positions at an interval of about 120 degrees in the circumferential direction of the casing 4 as shown in FIG. 11, for example.

The thrust support member 17 of the ball coupling mechanism 84 (described hereinafter) is fitted in the first support member mount portion 82A as shown in FIG. 12. Pair of rotation preventing grooves 82A1 and 82A1, which are recessed grooves with small diameters, are formed in the peripheral wall of the first support member mount portion 82A. The rotation preventing projections 17B of the thrust support member 17 are respectively engaged with the rotation preventing grooves 82A1.

Meanwhile, the second support member mount portion 82B is formed as a bottomed hole having a larger diameter than that of the first support member mount portion 82A. The elastic ring 29 is mounted with interference on the peripheral wall side of the second support member mount portion 82B with no space between the elastic ring 29 and the self-rotation suppressing support member 24 of the ball coupling mechanism 85 (described hereinafter).

Reference numerals 83A and 83B denote first and second support member mount portions provided on the back surface side of the orbiting scroll 8. The first and second support member mount portions 83A and 83B have substantially the same configurations as those of the support member mount portions 10A and 10B of the orbiting scroll 8 described in the first embodiment. In this case, however, the support member mount portions 83A and 83B are different from those of the first embodiment in that the support member mount portions 83A and 83B are disposed at positions axially facing the support member mount portions 82A and 82B of the casing 4.

As shown in FIG. 12, the thrust support member 18 of the ball coupling mechanism 84 (described hereinafter) is fitted in the first support member mount portion 83A. The self-rotation suppressing support member 25 of the ball coupling mechanism 85 (described hereinafter) is fitted in the second support member mount portion 83B that is spaced apart from the first support member mount portion 83A.

Reference numeral 84 denotes the first ball coupling mechanism employed in the present embodiment to support the thrust load. The first ball coupling mechanism 84 has substantially the same configuration as that of the first ball coupling mechanism 16 described in the first embodiment, and includes the pair of thrust support members 17 and 18, the load supporting ball 19 and the elastic pad 22.

However, according to the present embodiment, the total of three first ball coupling mechanisms 84 are provided on the outer peripheral side of the bearing mount portion 4C of the casing 4 as shown in FIG. 11. The three ball coupling mechanisms 84 are disposed at substantially regular intervals (at intervals of about 120 degrees) in the circumferential direction centering on the bearing mount portion 4C.

Reference numeral 85 denotes the second ball coupling mechanism for preventing the self-rotation of the orbiting scroll 8. The second ball coupling mechanism 85 has substantially the same configuration as that of the second ball coupling mechanism 23 described in the first embodiment, and includes the pair of self-rotation suppressing support members 24 and 25, the self-rotation preventing ball 26 and the elastic ring 29.

However, according to the present embodiment, the total of two second ball coupling mechanisms 85 are provided on the outer peripheral side of the bearing mount portion 4C of the casing 4. The two ball coupling mechanisms 85 are spaced by a given angle (for example, 90 to 170 degrees) in the circumferential direction centering on the bearing mount portion 4C. That is, the total of two second ball coupling mechanisms 85 and 85 are disposed so as not to be located on a line passing through the center (for example, the axis line O2-O2 shown in FIG. 3) of the orbiting scroll 8, so that the two second ball coupling mechanisms 85 and 85 and the center position of the orbiting scroll 8 do not lie on a straight line.

In the present embodiment having the aforementioned configuration, it is possible to obtain substantially the same effects as those of the aforementioned first embodiment. In particular, in the present embodiment, the first ball coupling mechanism 84 is disposed at three positions at intervals in the circumferential direction of the orbiting scroll 8, and the second ball coupling mechanism 85 is disposed at two positions at an interval in the circumferential direction of the orbiting scroll 8.

Herewith, while the number of the load supporting balls 19 and the number of the self-rotation preventing balls 26 are reduced to the required minimum, the thrust load can be supported by the first ball coupling mechanisms 84, and the rotation can be prevented by the second ball coupling mechanisms 85. Thus, the number of components can be reliably reduced.

If the two second ball coupling mechanisms are disposed on the opposite sides from each other in the radial direction across the center position of the orbiting scroll 8, the two second ball coupling mechanisms and the center position of the orbiting scroll 8 lie on a straight line. In this case, the rotational torque (the rotational force) in a direction perpendicular to the straight line cannot be supported by the two second ball coupling mechanisms.

On the other hand, in the present embodiment, the two second ball coupling mechanisms 85 are disposed at an interval in the circumferential direction of the orbiting scroll 8 so as not to be located on a line passing through the center position of the orbiting scroll 8. Therefore, the rotational torque in all the directions can be received and supported by using the two second ball coupling mechanisms 85, thereby effectively preventing the self-rotation of the orbiting scroll 8.

In the aforementioned first embodiment, the case in which the rotation preventing projections 17B are provided on the thrust support member 17 of the first ball coupling mechanism 16 to hold the thrust support member 17 with the rotation being prevented in the support member mount portion 5A is described. However, the present invention is not limited to the case. For example, the rotation of the thrust support member may be prevented by using rotation preventing means such as a key. Alternatively, the rotation of the thrust support member may be prevented by forming the outer shape of the thrust support member into a noncircular shape such as square and oval. This can be applied to the second to sixth embodiments.

In the aforementioned first embodiment, the case in which the pin 30 holds the self-rotation suppressing support member 24 of the second ball coupling mechanism 23 with the rotation being prevented in the support member mount portion 5B is described. However, the present invention is not limited to the case. For example, the rotation of the self-rotation suppressing support member may be prevented by using rotation preventing means such as a key. Alternatively, the rotation of the self-rotation suppressing support member may be prevented by forming the outer shape of the self-rotation suppressing support member into a noncircular shape such as square and oval. This can be applied to the second to sixth embodiments.

In the aforementioned first embodiment, the case in which the first and second ball coupling mechanisms 16 and 23 are disposed with a space from each other in the radial direction of the orbiting scroll 8 is described. However, the present invention is not limited to the case. For example, the first and second ball coupling mechanisms may be disposed with a space from each other in the circumferential direction of the orbiting scroll. This can be applied to the second to fifth embodiments.

In the aforementioned first embodiment, the case in which the load supporting ball 19 and the self-rotation preventing ball 26 are formed to have the diameters equal to each other (D1=D2) is described. However, the present invention is not limited to the case. For example, the load supporting ball of the first ball coupling mechanism may be formed to have a larger diameter than that of the self-rotation preventing ball of the second ball coupling mechanism. In this case, the contact stress can be reduced by increasing a contact area between the pair of thrust support members and the load supporting ball, thereby extending the operating life of the first ball coupling mechanism.

In the case where the self-rotation preventing ball of the second ball coupling mechanism has a smaller diameter than that of the load supporting ball of the first ball coupling mechanism, a plurality of second ball coupling mechanisms may be provided around one first ball coupling mechanism.

In the aforementioned first embodiment, the case in which the first and second ball coupling mechanisms 16 and 23 are provided between the back surface side of the orbiting scroll 8 and the casing 4 is described. However, the present invention is not limited to the case. For example, the first ball coupling mechanisms may be provided between the orbiting scroll and the casing, and the second ball coupling mechanisms may be provided between the orbiting scroll and the fixed scroll. In this case, the first and second ball coupling mechanisms can be disposed with a space from each other on the front and back sides of the orbiting scroll (in the axial direction of the casing). Therefore, the orbiting scroll or the like can be reduced in dimension in the radial direction, and the entire apparatus can be reduced in volume.

In the aforementioned third embodiment, the case in which the thrust support members 17 and 18 and the self-rotation suppressing support members 24 and 25 are formed separately from the casing 4 and the orbiting scroll 8 as respective mounting targets is described. However, the present invention is not limited to the case. For example, the thrust support members and the self-rotation suppressing support members may be formed integrally with the casing and the orbiting scroll as the respective mounting targets. This can be applied to the fourth and fifth embodiments, for example.

In the aforementioned first embodiment, the case in which the ball coupling devices 15 are disposed independently at three positions at intervals in the circumferential direction is described. However, the present invention is not limited to the case. For example, the ball coupling devices (the first and second ball coupling mechanisms) may be disposed independently at four or more positions at intervals in the circumferential direction. This can be applied to the other embodiments.

In the aforementioned first embodiment, the ball coupling devices 15 (the first and second ball coupling mechanisms 16 and 23) are arranged between the casing 4 and the orbiting scroll 8. However, the present invention is not limited thereto. For example, the ball coupling devices may be provided between the fixed-side member (the fixed scroll) and the orbiting scroll in a case where the thrust load acts in a direction in which the orbiting scroll and the fixed scroll approach each other. This can be applied to the other embodiments.

In each of the aforementioned embodiments, the elastic pad 22 constituting the elastic member is provided in the first ball coupling mechanism 16. However, when the first ball coupling mechanism 16 is arranged at three positions by using the end plate 8A of the orbiting scroll which has small distortion when heated (especially, in the thrust direction), the elastic pad 22 may not be provided since the thrust force from the orbiting scroll 8 can be supported at the three positions. When the first ball coupling mechanisms 16 are arranged at four or more positions, the elastic pad 22 can prevent the backlash or the like in the thrust direction.

In each of the aforementioned embodiments, a vulcanization process as a cross-linking reaction may be used by adding sulfur to rubber raw material as a method of providing an elastic film. The elasticity and strength of the elastic film can be ensured by the vulcanization process.

Although the scroll air compressor is described as an example in each of the aforementioned embodiments, the present invention is not limited thereto. For example, the present invention can be widely applied to a scroll vacuum pump, a scroll refrigerant compressor or the like.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll fluid machine comprising:

a fixed-side member comprising a cylindrical casing and a fixed scroll fixed to the casing and having a spiral wrap portion erected on an end plate thereof;

an orbiting scroll provided in the casing for orbit so as to face the fixed scroll of the fixed-side member and having a spiral wrap portion erected on an end plate thereof;

a plurality of fluid chambers defined between the orbiting scroll and the fixed scroll to compress or expand a fluid between said wrap portions when the orbiting scroll orbits; and a plurality of ball coupling devices provided between said fixed-side member and said orbiting scroll to prevent self-rotation of the orbiting scroll on its axis and receive a thrust load between the fixed-side member and the orbiting scroll, wherein each of the ball coupling devices comprises:

a first ball coupling mechanism for supporting the thrust load generated between the fixed-side member and the orbiting scroll by using a load supporting ball; and a second ball coupling mechanism disposed with a space from the first ball coupling mechanism to prevent the self-rotation of the orbiting scroll by using a self-rotation preventing ball, said second ball coupling mechanism comprising an elastic member for elastically supporting the self-rotation preventing ball in a radial direction of the orbiting scroll so as to suppress the effect of the backlash to the self-rotation direction that can affect said first ball coupling mechanism.

2. The scroll fluid machine according to claim 1, wherein the first ball coupling mechanism comprises a pair of thrust support members provided facing each other in the fixed-side member and the orbiting scroll and having ball support surfaces facing each other with the load supporting ball held therebetween to receive the thrust load, and the second ball coupling mechanism comprises a pair of self-rotation suppressing support members provided facing each other in the fixed-side member and the orbiting scroll and having ball support surfaces facing each other with the self-rotation preventing ball held therebetween to prevent the self-rotation of the orbiting scroll on its axis.

3. The scroll fluid machine according to claim 2, wherein the load supporting ball of the first ball coupling mechanism is in rolling-contact with the pair of thrust support members in a direction along the thrust load, and the self-rotation preventing ball of the second ball coupling mechanism is in rolling-contact with the pair of self-rotation suppressing support members in a direction inclined from the direction along the thrust load.

4. The scroll fluid machine according to claim 2, wherein each of the thrust support members of the first ball coupling mechanism comprises an annular guide groove in the ball support surface to guide the load supporting ball for rolling in accordance with a orbiting movement of the orbiting scroll, said ball support surface in each of the self-rotation suppressing support members of the second ball coupling mechanism comprises a conically recessed surface including a tapered peripheral wall that is inclined relative to a direction of the thrust load to prevent the self-rotation of the orbiting scroll on its axis and with that the self-rotation preventing ball is in rolling-contact.

5. The scroll fluid machine according to claim 2, wherein the elastic member of the second ball coupling mechanism elastically supports at least one of the self-rotation suppressing support members in the radial direction of the orbiting scroll along with the self-rotation preventing ball.

6. The scroll fluid machine according to claim 2, wherein the first ball coupling mechanism comprises self-rotation preventing means for holding the thrust support member with its rotation being stopped.

7. The scroll fluid machine according to claim 2, wherein the second ball coupling mechanism comprises another self-rotation preventing means for holding the self-rotation suppressing support member with its rotation being prevented.

8. The scroll fluid machine according to claim 1, wherein at least three the ball coupling devices are disposed, with intervals in a circumferential direction, on an outer peripheral side of the orbiting scroll.

9. The scroll fluid machine according to claim 1, wherein the first ball coupling mechanism receives a larger thrust load than the second ball coupling mechanism when the thrust load is applied to the orbiting scroll.

10. The scroll fluid machine according to claim 1, wherein the second ball coupling mechanism receives a larger rotational force than the first ball coupling mechanism when the rotational force is applied to the orbiting scroll.

11. The scroll fluid machine according to claim 1, wherein the elastic member is formed by a vulcanization process.

12. A scroll fluid machine comprising:

a fixed-side member comprising a cylindrical casing and a fixed scroll fixed to the casing and having a spiral wrap portion erected on an end plate thereof;

an orbiting scroll provided in the casing for orbit so as to face the fixed scroll of the fixed-side member and having a spiral wrap portion erected on an end plate thereof;

a plurality of fluid chambers defined between the orbiting scroll and the fixed scroll to compress or expand a fluid between said wrap portions when the orbiting scroll orbits; and a plurality of ball coupling devices provided between said fixed-side member and said orbiting scroll to prevent self-rotation of the orbiting scroll on its axis and receive a thrust load between the fixed-side member and the orbiting scroll, wherein each of the ball coupling devices comprises:

a first ball coupling mechanism for supporting the thrust load generated between the fixed-side member and the orbiting scroll by using a load supporting ball; and a second ball coupling mechanism disposed with a space from the first ball coupling mechanism to prevent the self-rotation of the orbiting scroll by using a self-rotation preventing ball, said second ball coupling mechanism comprising an elastic member for elastically supporting the self-rotation preventing ball in a radial direction of the orbiting scroll, and wherein the first ball coupling mechanism includes a first elastic member for elastically supporting the load supporting ball in a direction of the thrust load.

13. A scroll fluid machine comprising:

a fixed-side member comprising a cylindrical casing and a fixed scroll fixed to the casing and having a spiral wrap portion erected on an end plate thereof;

an orbiting scroll provided in the casing for orbit so as to face the fixed scroll of the fixed-side member and having a spiral wrap portion erected on an end plate thereof;

a plurality of fluid chambers defined between the wrap portions of the orbiting scroll and the fixed scroll to compress or expand a fluid between said wrap portions when the orbiting scroll orbits; and a plurality of ball coupling devices provided between the fixed-side member and the orbiting scroll to prevent self-rotation of the orbiting scroll on its axis and receive a thrust load between the fixed-side member and the orbiting scroll, wherein each of the ball coupling devices comprises:

a first ball coupling mechanism comprising a pair of thrust support members provided facing each other in the fixed-side member and the orbiting scroll and having ball support surfaces facing each other to receive the thrust load, and a load supporting ball held between the pair of thrust support members to receive the thrust load via the respective ball support surfaces; and a second ball coupling mechanism comprising a pair of self-rotation suppressing support members provided facing each other in the fixed-side member and the orbiting scroll and having ball support surfaces facing each other to prevent the self-rotation of the orbiting scroll on its axis, and a self-rotation preventing ball held between the pair of self-rotation suppressing support members to prevent the self-rotation of the orbiting scroll on its axis via the respective ball support surfaces, said second ball coupling mechanism comprising an elastic member for elastically supporting the self-rotation preventing ball in a radial direction of the orbiting scroll, and an orbit radius of the self-rotation preventing ball when the orbiting scroll orbits is made to be smaller than an orbiting radius of the orbiting scroll, and the elastic member is made to be elastically deformed in the radial direction of the orbiting scroll by a difference between the orbiting radius of the orbiting scroll and the orbit radius of the self-rotation preventing ball.

* * * * *